US008873347B2

(12) United States Patent
Goeller

(10) Patent No.: US 8,873,347 B2
(45) Date of Patent: Oct. 28, 2014

(54) MECHANISM FOR ISOLATING TIMEPIECE MECHANISMS WHICH RELEASE VARIOUS ACOUSTIC SIGNALS

(75) Inventor: Eric Goeller, Les Hopitaux-Vieux (FR)

(73) Assignee: Montres Breguet S.A., L'Abbaye (CH)

( * ) Notice: Subject to any disclaimer, the term of this patent is extended or adjusted under 35 U.S.C. 154(b) by 319 days.

(21) Appl. No.: 13/413,312

(22) Filed: Mar. 6, 2012

(65) Prior Publication Data

US 2012/0230156 A1 Sep. 13, 2012

(30) Foreign Application Priority Data

Mar. 8, 2011 (EP) ..... 11157272

(51) Int. Cl.
*G04B 21/06* (2006.01)
*G04B 21/00* (2006.01)

(52) U.S. Cl.
CPC ..... *G04B 21/00* (2013.01)
USPC ..... 368/261; 368/267; 368/72

(58) Field of Classification Search
CPC ..... G04B 21/00–21/04
USPC ..... 368/72, 75, 261, 267–270
See application file for complete search history.

(56) References Cited

U.S. PATENT DOCUMENTS

| | | | | |
|---|---|---|---|---|
| 4,508,456 | A * | 4/1985 | Hepfer et al. | 368/262 |
| 7,021,819 | B2 * | 4/2006 | Schmiedchen | 368/147 |
| 7,065,005 | B2 * | 6/2006 | Rochat | 368/72 |
| 7,322,742 | B2 * | 1/2008 | Goeller | 368/147 |
| 7,420,882 | B2 * | 9/2008 | Goeller | 368/75 |
| 7,443,769 | B2 * | 10/2008 | Goeller | 368/275 |
| 2008/0008052 | A1 * | 1/2008 | Moteki | 368/260 |
| 2008/0273426 | A1 | 11/2008 | Corthesy et al. | |
| 2010/0214884 | A1 | 8/2010 | Corthesy et al. | |

FOREIGN PATENT DOCUMENTS

| | | | |
|---|---|---|---|
| CH | 689 337 | A5 | 2/1999 |
| EP | 0 451 334 | A1 | 10/1991 |
| EP | 1 708 051 | A1 | 10/2006 |
| EP | 1 925 997 | A1 | 5/2008 |
| FR | 1.061.326 | | 4/1954 |

OTHER PUBLICATIONS

European Search Report issued Sep. 13, 2011, in European Application No. 11157272.3 filed Mar. 8, 2011 (with English Translation).
U.S. Appl. No. 13/413,223, filed Mar. 6, 2012, Goeller.

* cited by examiner

*Primary Examiner* — Amy Cohen Johnson
*Assistant Examiner* — Jason Collins
(74) *Attorney, Agent, or Firm* — Oblon, Spivak, McClelland, Maier & Neustadt, L.L.P.

(57) ABSTRACT

A timepiece includes a movement, a main striking mechanism, a secondary strike release mechanism, and a mode selecting mechanism. The main striking mechanism is controlled by a main strike control mechanism, arranged to release strikes, at times programmed by the movement, or on demand, and a sequence of each strike is determined by information gathered by feeler spindles on snails or time references driven by the movement. A coupling mechanism of the secondary strike release mechanism actuates a control rod linkage of an isolating mechanism arranged to isolate various different release mechanisms for different strikes using the main striking mechanism to play strikes. The isolating mechanism includes at least a first isolator which, in a first winding position, takes a stop position preventing the spindles from gathering information from the snails, and, in a second let down position, allows the spindles to pass to come into contact with the snails.

13 Claims, 18 Drawing Sheets

Fig. 17
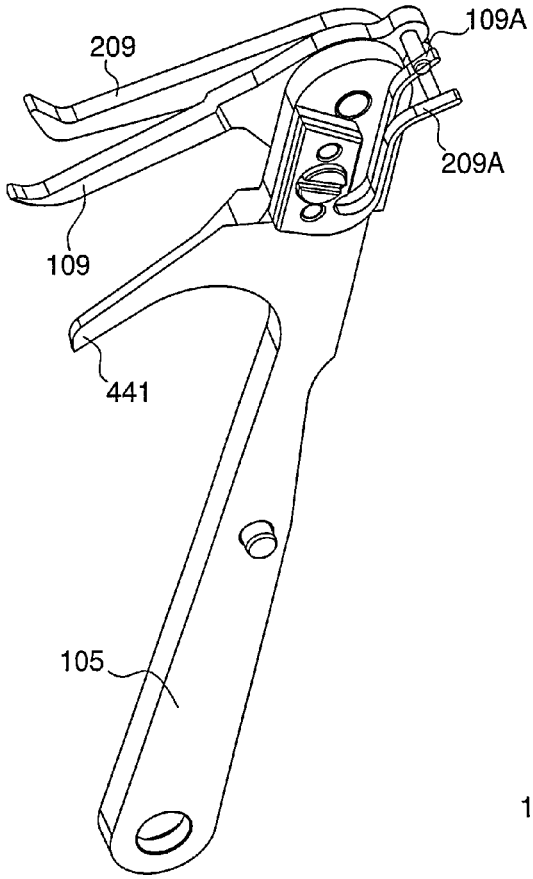
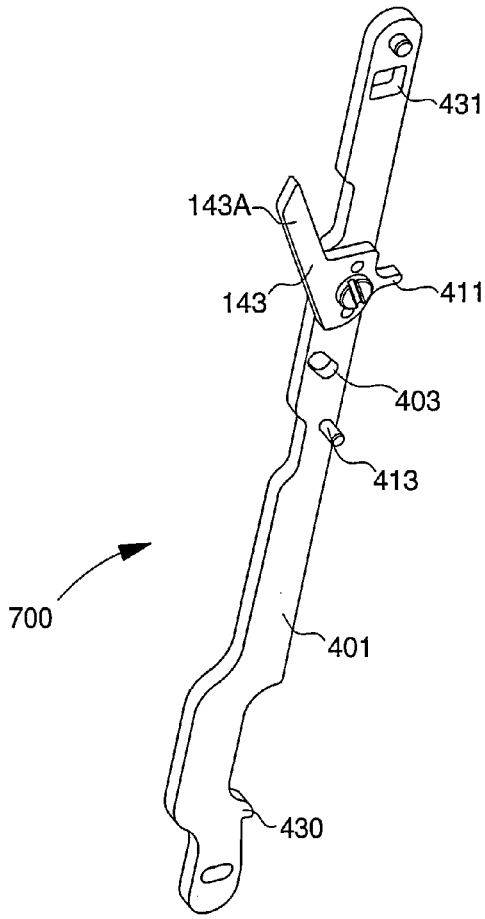
Fig. 18

D
2
4
7
5
8
3
119
9
118
173
171
174
6
3A
176
181
172
175
187
183
182
12
6A
11
9A
9B

MECHANISM FOR ISOLATING TIMEPIECE MECHANISMS WHICH RELEASE VARIOUS ACOUSTIC SIGNALS

This application claims priority from European Patent Application No. 11157272.3 of Mar. 8, 2011, the entire disclosure of which is incorporated herein by reference.

FIELD OF THE INVENTION

The invention concerns a timepiece including at least one movement, and including, on the one hand, at least one main striking mechanism controlled by a main strike control mechanism, arranged to release strikes, either at times programmed by said movement, or on demand, and wherein the sequence of each strike is determined by the information gathered by feeler spindles on snails or time references driven by said movement, and on the other hand, a secondary strike release mechanism for operating at least one secondary strike control mechanism at a specific time and including a coupling mechanism arranged to allow the exclusive operation, at a given time, of either a single said secondary strike control mechanism, or only the main strike control mechanism, The invention concerns the field of horology, and more specifically the field of timepieces including striking mechanisms, particularly repeaters.

BACKGROUND OF THE INVENTION

Repeater strike mechanisms are exceptional timepieces, as regards their large number of components and the care and time required for fabrication and assembly operations. Striking mechanism complications have been known since at least the XVIII century, but have only been the subject of a limited number of publications between 1763 and the middle of the XX century. The reference work best known to the practitioner of complications, in particular grand strikes and repeaters, to which reference will be made to avoid overloading the presentation of the invention, is the work "Les montres compliquées" (Complicated watches) by François Lecoultre and edited by Editions Horlogères in Bienne.

Often, the space available inside complicated timepieces, in particular watches, is such that it is not possible to duplicate certain functions, in particular acoustic functions, inside the case, and a choice therefore has to be made between acoustic and/or musical functions.

More specifically, the alarm function is a separate complication from the grand strike or minute repeater complications.

EP Patent Application No. 0 451 331 A1 in the name of IWC discloses a repeater watch, two strike devices for striking mechanisms with coupling devices, one of which is also a locking device.

EP Patent Application No. 1925 997 A1 in the name of CHRISTOPHE CLARET SA discloses a striking mechanism controlled by a cam shaft, with locking after the striking mechanism has been operated, and including a silencer with a bolt for locking the control member. The striking mechanism includes an energy source for driving the racks and a gear train connecting the energy source to a regulating member. The racks are kinematically connected to the energy source via a striking mechanism drive device arranged in the gear train and activated by a control member. The racks are intended to cooperate with snails to extract information regarding the current time. The control member is a cam shaft provided with at least one cam cooperating with the drive device via at least one connecting element and at least one drive wheel set for pivoting said cam when the striking mechanism is released.

EP Patent No. 1 708 051 A1 in the name of ZENITH INTERNATIONAL SA discloses an alarm mechanism that can be uncoupled. It includes an energy source which is locked when the mechanism is at rest and unlocked when it is operating. It includes a setting system for programming the strike time. It includes a release system comprising a control member which governs the unlocking of the energy source, and a cam kinematically connected to the movement and performing one revolution in twenty-four hours. It includes a striking mechanism driven by said energy source, and provided with a hammer for striking a gong or an object that does not resonate. The control member is provided with an arm which ends in a first catch, and the cam includes a single notch for receiving said catch in order to unlock the energy source.

FR Patent No. 1 061 326 in the name of GIROD discloses a chime with a lever for locking parts of the striking mechanism when the reason for the strike changes. It allows a reduction in the number of components of a striking mechanism, without isolating one striking mechanism from another.

CH Patent Application No. 689 337 A5 in the name of PATEK PHILIPPE SA discloses a Westminster chime with a striking mechanism isolator when the time is being set, and a device for preventing an automatic strike when a striking mechanism is being played manually, and a silence lever. The quarter pieces are not isolated, but released alternately, on each quarter hour.

FR Patent No 455 174 A, in the name of BORDONI GUGGERI, discloses an alarm mechanism which includes a device automatically striking the hours and quarters with hour and quarter repeaters. It includes a toothed sector and a rack, replacing the hour snail, and elastically connected to a strike wheel. The toothed sector moves forward by one tooth when the mechanism prepares the hour strike for the next blow, and the forward movement is produced by stopping the rack on the periphery and by lowering the arbour thereof. There is a pause between the hour strike and the quarter strike owing to a transmission ratio selected to give an additional strike, which is stopped by a bent lever releasing the quarter hammer.

CH Patent Application No. 252 169A in the name of PAILLARD discloses a timing device including an operating member which can tip, held in two positions by a spring, and an activating member which, after a time determined by the position of an adjusting member, causes the operating member to tip from one of its two positions to the other.

SUMMARY OF THE INVENTION

The invention proposes to improve the operating safety of striking timepieces, particularly watches, by preventing the movement of certain mechanisms when others are active.

The invention proposes, in particular, to develop a simple mechanism for ensuring the safety of sound transmission functions, in particular of the striking mechanism or alarm, in order, when a sound transmission function is in operation, to limit the travel of mobile elements connected to the performance of other sound functions of the same timepiece.

The invention concerns a timepiece including at least one movement, and including, on the one hand, at least one main striking mechanism controlled by a main strike control mechanism, arranged to release strikes, either at times programmed by said movement, or on demand, and wherein the sequence of each strike is determined by the information gathered by feeler spindles on snails or time references driven by said movement, and on the other hand, a secondary strike release mechanism for operating at least one secondary strike control mechanism at a specific time and including a coupling mechanism arranged to allow the exclusive operation, at a given time, of either a single said secondary strike control mechanism, or only the main strike control mechanism, characterized in that said timepiece includes mode selecting means for exclusively selecting, either a secondary strike mode by winding said coupling mechanism to uncouple the main striking mechanism and couple a secondary striking mechanism, or a main strike mode by activating said main strike control mechanism and letting down said coupling mechanism to uncouple said secondary striking mechanism using said main striking mechanism and, either not to play the secondary strike via said main striking mechanism, or to play said secondary strike by a mechanism other than said main striking mechanism, and further characterized in that said coupling mechanism actuates a control rod linkage of an isolating mechanism arranged to isolate various different release mechanisms for different strikes using, at least partially, the same main striking mechanism to play said strikes, said isolating mechanism includes at least a first isolator which, in a first winding position, takes a stop position preventing said feeler spindles from gathering information from said snails, and, in a second let down position, allows said feeler spindles to pass to come into contact with said snails.

BRIEF DESCRIPTION OF THE DRAWINGS

Other features and advantages of the invention will appear more clearly upon reading the following detailed description, with reference to the annexed drawings, in which:

FIGS. 5 to 19 show schematic, partial and perspective views of details of the timepiece of FIGS. 2 and 3:

FIG. 5 illustrates a minute repeater control device integrated in the timepiece.

FIG. 6 shows a striking mode selector, in the form of a column wheel, and the connection thereof to a large control device comprised in the invention for making the striking mechanism play the alarm sound.

FIG. 7 shows a selector indirectly controlled by this large control device, in a position close to clicks comprised in a release lever, for actuating either a strike or the alarm, depending on the command given to the large control device.

FIG. 8 shows one detail of the large control device and the connections thereof to the operating members comprising a timing hook, a first isolator, and a second isolator, which actuate or prevent the mode selecting movements of the ratchets, or control the duration of the strike.

FIG. 9 illustrates more specifically the interface between the timing hook of FIG. 8 with, on the one hand, a timing wheel set according to the invention, and on the other hand, a lever for stopping the alarm manually.

FIG. 10 illustrates the connections of the second isolator of FIG. 8 to, on the one hand, the timing hook and on the other hand a pivoting selector part.

FIG. 11 shows the cooperation between the timing hook and a ratchet comprised in the timing wheel set of FIG. 9.

FIG. 12 shows a push-button for stopping the alarm manually and the connection thereof to the timing hook, and illustrates the position of the pivoting selector part between the second isolator carried by the large control device, and the selector of FIG. 7, controlled by said pivoting selector part.

FIG. 13 shows the pivoting selector part, between the large control device and the selector, said selector being arranged opposite the clicks of the pivoting release part, in front of the striking mechanism unit.

FIG. 14 shows a release wheel set controlled by the large control device, in proximity to the striking mechanism unit, with which, in a meshing position, it can control the actuation of at least one hammer lifting piece for the alarm striking mechanism.

FIG. 15 shows, in a similar manner to FIG. 14, but seen from the other side of the mechanism, the coupling wheel set of FIG. 14 and the environment thereof in proximity to one end of the large control device.

FIG. 16 shows yet another view of this release wheel set, in front of the striking mechanism unit shown meshed, on an alarm release wheel comprised therein, with a timing wheel comprised in a timing wheel set having the function of limiting the duration of the alarm strike.

FIG. 17 shows the release lever of FIG. 7, provided with the two clicks thereof for controlling the release, respectively, of the strike or alarm, and one arm visible in FIG. 3 for cooperating with a winding cam for controlling the winding of said release lever.

FIG. 18 shows the large control device, to which the second isolator is fixed, together with the guide members thereof for operating the first isolator and the timing hook.

FIG. 19 shows, under the minute and quarter pieces of the timepiece, the striking mechanism unit, the timing wheel set, the coupling wheel set and the wheels sets carried by the large control device.

DETAILED DESCRIPTION OF PREFERRED EMBODIMENTS

The invention concerns the field of horology, and more specifically the field of timepieces including striking mechanisms, particularly repeaters.

The invention concerns new complications added to the striking mechanism.

In particular, the invention concerns the adaptation of a timepiece 1000, which includes a striking or grand strike or minute repeater mechanism 100, in order to use all or part of this so-called main striking mechanism as the acoustic display of another function, called the secondary strike function, which is different from the main strike function, and particularly of an alarm mechanism. Timepiece 1000 shown in the Figures is a wristwatch, which incorporates various complications which are the subject of the present invention.

The general term "striking mechanism" means hereinafter any transmission of sound or music, and in particular a sound transmission achieved by a hammer striking a gong, or similar, in accordance with the known mechanisms of striking timepieces or musical boxes.

Figure 1:
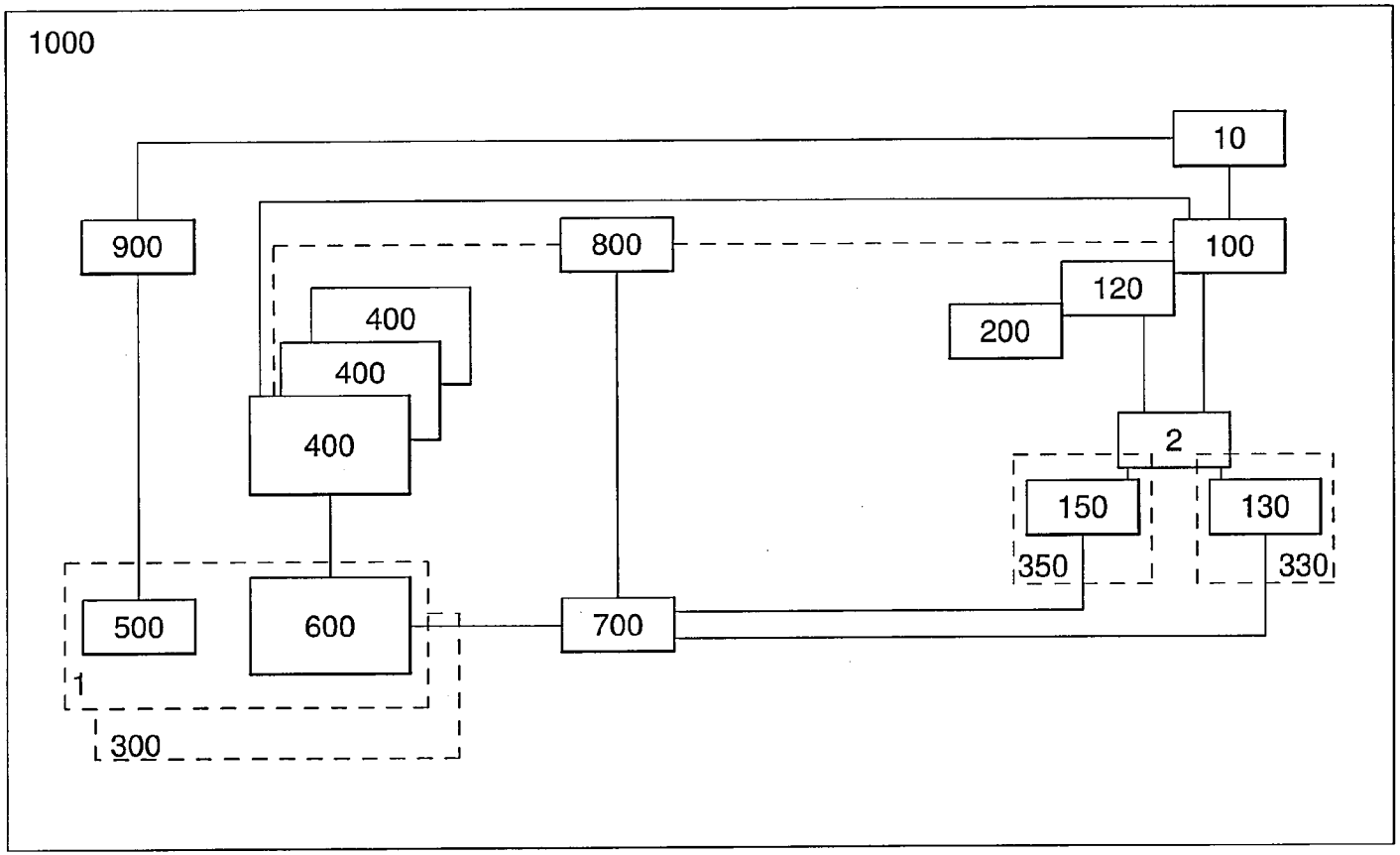
FIG. 1 shows a schematic, block diagram of a timepiece including a timepiece movement comprising a timepiece mechanism, a striking mechanism, an alarm control mechanism and a strike control mechanism according to the invention.

FIG. 1 illustrates the composition of a complicated timepiece 1000, particularly a watch. This timepiece 1000 includes, in a conventional manner, at least one timepiece movement 200 and, on the one hand, at least one secondary strike control means 400 for releasing a so-called secondary strike, for example an alarm strike, at a particular moment linked to a pre-setting, and/or reception of a signal, and/or the breach of a threshold value for a physical parameter, and on the other hand at least one striking or grand strike or minute repeater mechanism 100 controlled by main strike control means 10. This control means 10 is interfaced with the timepiece movement 200 and arranged to release a main striking mechanism at times programmed by the timepiece movement 200, or on demand, in particular in the case of a minute repeater, such as the example illustrated in the Figures. This mechanism 100 is preferably a repeater striking mechanism.

According to the particular case, the timepiece movement 200 or striking mechanism 100 includes drive means 120 for driving a sound mechanism.

Timepiece 1000 includes, a in preferred embodiment of the invention, illustrated by the Figures, a secondary strike release mechanism 1 which may consist of an alarm mechanism 300 and which advantageously includes mode selecting means 500 and coupling means 600. However, the grouping of the operating units in FIG. 1 is an illustration: they may form part of another mechanism of timepiece 1000, for example selecting means 500 may be integrated in the main strike control means 10 or even in the main striking mechanism 100.

This secondary strike release mechanism 1 enables all or part of a main striking mechanism 100 to be used to play a strike controlled by a secondary strike control mechanism, via coupling means 600, and a control rod linkage 700 in the example embodiment, which is advantageously coupled to isolating means 800 which contribute to the operating safety of the assembly, by allowing only one command to be given at a time to the actual sound transmission mechanisms. The sound transmission means includes in any case a striking mechanism unit 2 integrated in the main striking mechanism 100 or interfaced therewith. In an advantageous variant, a secondary striking mechanism drive mechanism 350 integrates a coupling wheel set 150, interfaced with striking mechanism unit 2. In another variant for limiting the duration of a strike, a duration limiting mechanism 330 integrates a timing unit 130 also interfaced with striking mechanism unit 2. Another optional safety mechanism is a safety mechanism 900 which prevents any inadvertent operation starting a minute repeater, and which may be arranged between the secondary strike release mechanism 1 and the main strike control means 10 or be integrated therein, or in the main striking mechanism 100.

The sound control mechanism 400 may thus be released when a preset value is reached, either a time value in the case of an alarm, or the value of a physical quantity measured by a sensor such as pressure in the case of a mine or torpedo firing mechanism, or even a radioactivity, temperature or other threshold for personnel obliged to pass through dangerous areas, and it may be started by the reception, in a receiver placed in the timepiece, of an external signal requiring the user of the timepiece to be warned, such as a telephone call signal or similar, these applications being cited by way of non-limiting example.

Figure 2:
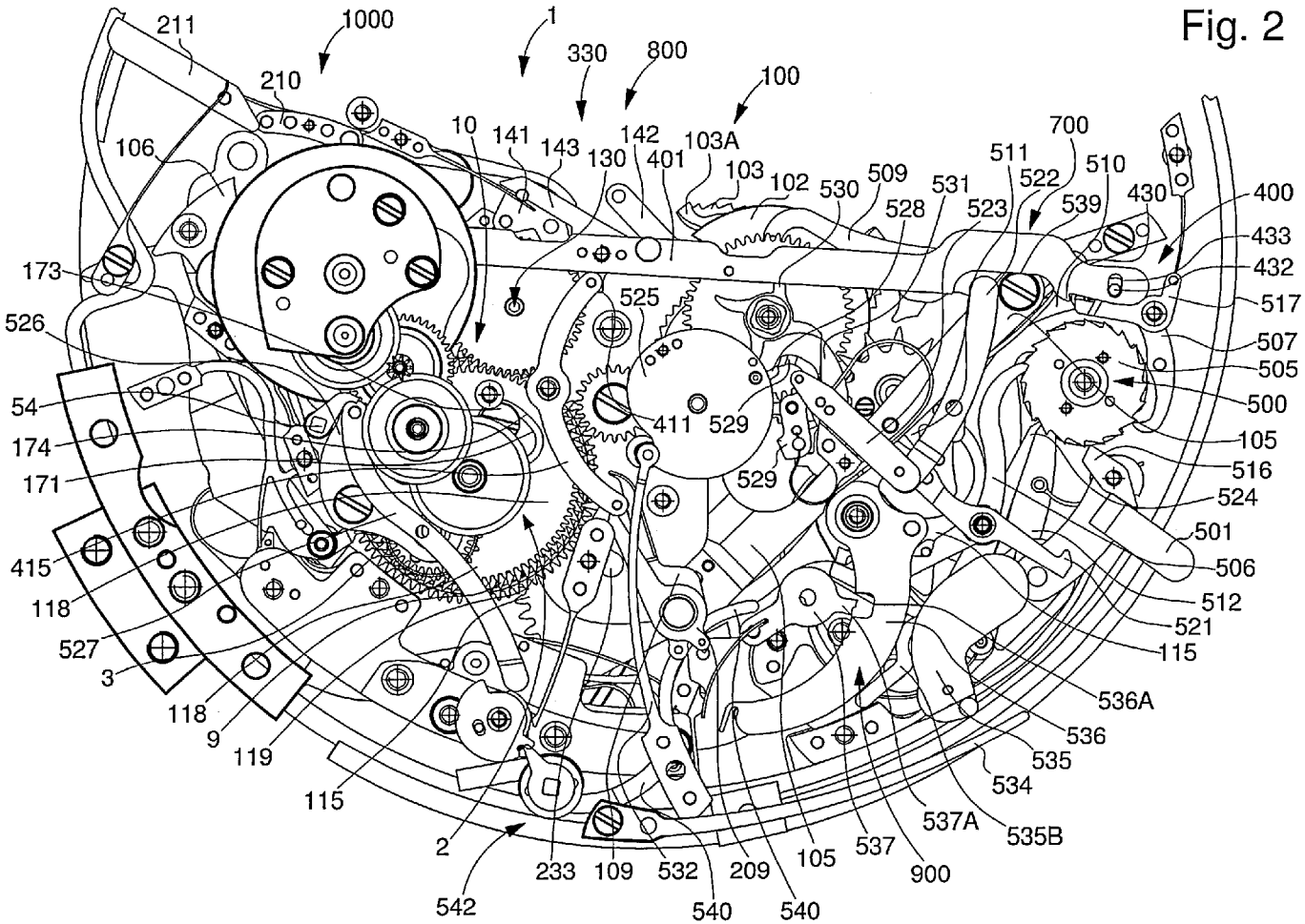
FIG. 2 shows a schematic, partial, plan, bottom view of part of a timepiece which includes a timepiece mechanism, a repeater striking mechanism, an alarm mechanism and a striking mechanism unit according to the invention.
Figure 3:
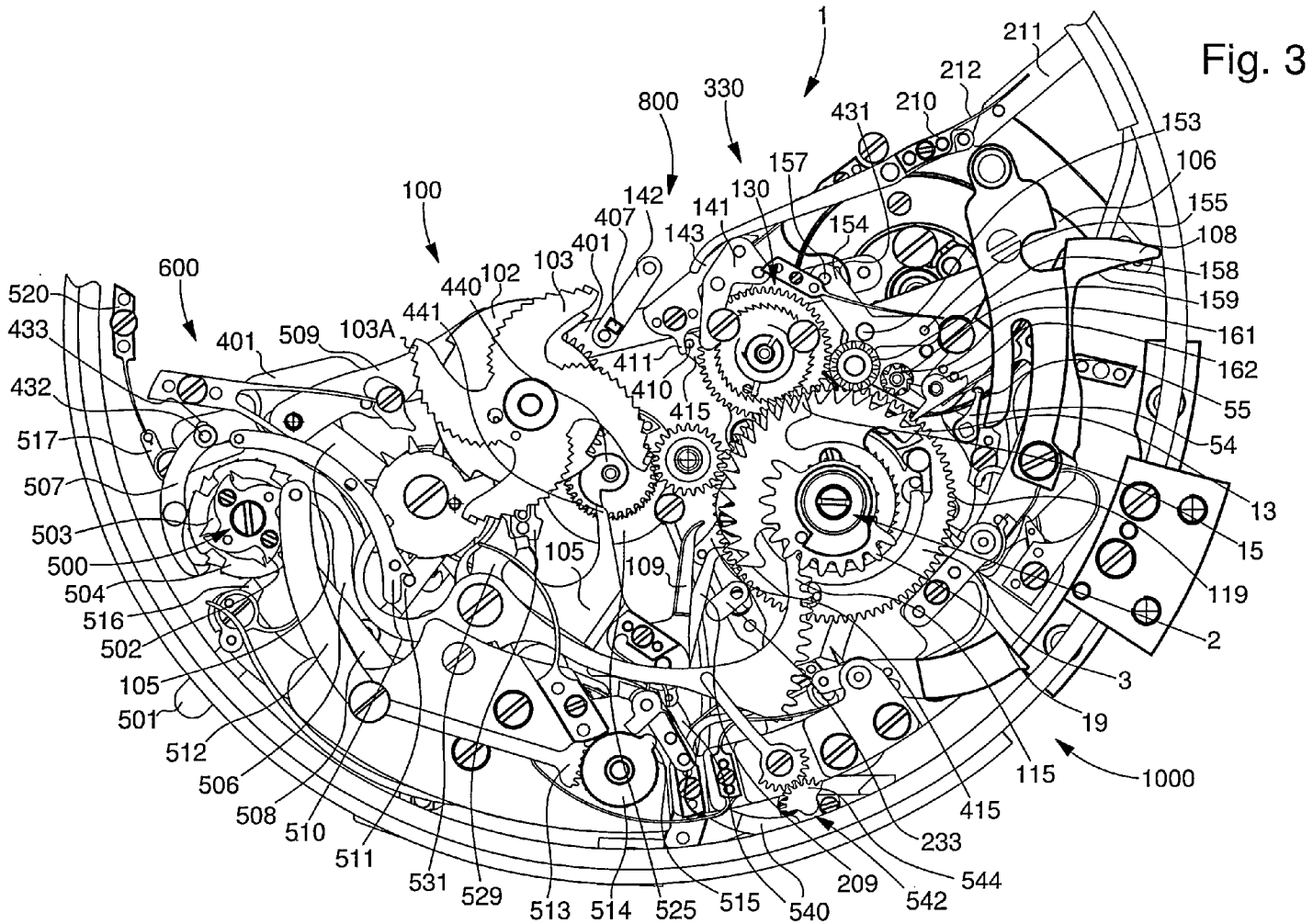
FIG. 3 shows a schematic, partial, plan view of the mechanism of FIG. 2, in a top view.

FIGS. 2 and 3 illustrate the cooperation, in a complicated timepiece 1000, between a repeater striking mechanism 100, and the complications belonging thereto, and a secondary striking mechanism, in particular formed by an alarm mechanism 300. The particular functions will be detailed in the description below.

The striking mechanism 100 presented here is of the instantaneous release type, and adopts, as seen in FIGS. 2 and 3, the features of the European Patent No. EP 1 798 611 by the same Applicant, the content whereof is incorporated herein by reference. In particular, the striking mechanism 100 includes a striking mechanism unit 2, which will be explained in detail in the following description, and which is adapted to the new functionalities of the invention.

Timepiece movement 200 includes a motion work, not shown in the Figures, which drives a release cam 530 seen in FIG. 2 in the form of a four-branched star. When the strike is released, striking mechanism unit 2 drives a plate 525 carrying a winding cam 440, both of which are visible in FIG. 3.

In automatic operation, the release cam 530 causes a release lever 105 to pivot towards a detent ratchet 9, comprised in striking mechanism unit 2, which will be described in detail hereinafter. The release lever 105 includes a first click 109 which pivots detent ratchet 9 to release the train of/from striking mechanism unit 2.

In manual operation, according to the teaching of EP Patent No 1 798 611 by the same Applicant incorporated herein by reference, a manual control member, such as the minute repeater push piece connected to the first lever 535 described hereinbefore, mechanically activates the release lever 105. The winding cam 440 cooperates with an arm 441 comprised in release lever 105, visible in FIGS. 3 and 17, to wind said lever against a return spring. This winding cam 440 includes a step, which allows the release lever 105 to be dropped again on release. Plate 525 includes a pivoting hook 528 which, when in the hooked position, at one end thereof, connects plate 525 to the ratchet of an intermediate wheel pivoted by the strike train. An opposite end of this hook 528, seen in FIG. 2, cooperates with a locking device including a control arm with locking hook 529 and, in a preferred variant illustrated here, an unhooking lever 531. Depending on its position, locking hook 529 locks or releases winding cam 440. It therefore allows all of the striking mechanisms to be stopped or released depending on its position. This locking hook 529 cooperates with a manual control lever for the manual release of the strike.

Unhooking lever 531 is pivotally mounted on this manual control lever, returned by a spring, and cooperates via one end with the release cam 530 and, via a finger, with a pin carried by the control arm with locking hook 529, and it causes locking hook 529 to pivot in the unlocked position when the unhooking lever 531 is itself released by the release cam 530.

The invention concerns a secondary strike release mechanism 1 for a timepiece 1000.

According to the invention, this secondary strike release mechanism 1 includes a coupling mechanism 600 arranged, at this specific moment of release of secondary strike control mechanism 400, to prevent a main strike to be carried out by uncoupling main strike control means 10 and to release a secondary strike acoustic signal by coupling the striking or grand strike or minute repeater mechanism 100, or at least a part of said mechanism. Outside said specific moment of release of the secondary strike control mechanism 400 and after the acoustic signal linked to said specific moment has been played which releases the secondary strike control mechanism 400, mechanism 1 is also arranged, to allow operation of a main strike by coupling main strike control means 10 and to release a main striking mechanism acoustic signal by coupling the striking or grand strike or minute repeater mechanism 100.

The secondary strike release mechanism 1 according to the invention is, in particular, applicable to a timepiece 1000 which includes several secondary strike control mechanisms 400 arranged in a hierarchy and taking priority over each other in series and all taking priority over main strike control means 10, to control the operation of at least one such secondary strike control mechanism 400 at a specific time.

According to the invention, the secondary strike release mechanism 1 then includes a means of comparing the priority levels of secondary strike control mechanisms 400, and an isolation mechanism 800, arranged, at the specific moment of release of one of said secondary strike control mechanisms 400, to prevent the operation thereof if an acoustic signal from another secondary strike control mechanism 400 of higher priority is being played, and to allow the operation thereof if no acoustic signal from another secondary strike control mechanism 400 of higher priority thereto is being played, in which case said isolation mechanism 800 prevents the operation of any other secondary strike control mechanism 400 of lower priority thereto.

The application of the invention is more specifically described for a particular, non limiting case, illustrated by the Figures, wherein at least one secondary strike control mechanism 400 is an alarm control mechanism 400 which includes a means of setting the desired alarm time, which is not detailed here. In this case the secondary strike release mechanism 1 is an alarm mechanism 300 controlled by an alarm control mechanism 400.

The secondary strike release mechanism 1 or timepiece 1000 preferably includes, and particularly in the version illustrated in the Figures, a mode selecting means 500.

This mode selecting means 500 is arranged to differentiate between and select, in timepiece 1000, at least, on the one hand a secondary striking mode, particularly an alarm striking mode, thus activating the secondary strike control mechanism 400, formed by an alarm control mechanism, and on the other hand one or several main striking modes, which may or may not be associated with a silent mode, activating the main strike control mechanism 10 which acts on a striking mechanism unit 2.

For example, the mode selecting means 500 may, in a timepiece 1000 provided with suitable complications, allow selection of various modes: alarm, grand strike, striking, small strike, minute repeater, silent strike mode. This list is in no way limiting.

This mode selecting means 500 is arranged, when the secondary striking mode is selected, particularly the alarm striking mode, to wind the coupling mechanism 600 to uncouple the main striking mechanism and to couple a secondary striking mechanism, particularly an alarm 300, controlled by alarm control mechanism 400, to play the alarm via a striking mechanism unit 2 comprised in the grand strike mechanism 100. This coupling mechanism 600 is also arranged, when the main striking mode is selected, to uncouple the secondary striking or alarm mechanism using the grand strike mechanism, and to either not play the secondary strike or alarm, or to play said secondary strike or alarm using a mechanism other than the grand strike.

The accumulation of energy, for the operation of timepiece movement 200 and the control, alarm and striking mechanisms is not described in detail here, either in terms of recharging or in terms of storage. The energy storing means may be a single means, for example in the form of a barrel of large dimensions which ensures both a suitable power reserve for the timepiece movement 200 and a power reserve for the operation of a certain number of strikes and alarms, as known from EP Patent No. 1 845 425 by the same Applicant, the content of which is incorporated herein by reference. The energy storage means may also be distinct, using barrels or similar each attributed to different functions.

In the non limiting example illustrated by the Figures which concerns a minute repeater and grand strike timepiece, the interface between the user and timepiece 1000 for the selection and control of striking and alarm functions is formed of three control members.

These three control members are additional to the control member for setting the alarm time, which is not described in detail here, and which may advantageously adopt the features of the European Patent No. EP 1 921 519 by the same Applicant, the content of which is incorporated herein by reference. In a preferred embodiment, which is not described in detail here, timepiece 1000 includes a push piece for setting the time of the movement, or setting the alarm time, the action on the push piece setting in motion a coupling which selects one or other motion-work.

Operation in the secondary striking mode, particularly the alarm mode, uses a secondary strike control mechanism, particularly an alarm control mechanism 400, arranged to release an acoustic signal at a programmed time, by the action of a coupling mechanism 600 comprised in alarm mechanism 300.

Advantageously, because of its simplicity, coupling mechanism 600 includes a control rod linkage 700, including a large control device 401, arranged to control a coupling wheel set 150 to play the secondary strike or alarm from a striking mechanism unit 2 comprised in the grand strike mechanism 100, and to control a timing wheel set 130 to define the duration of the secondary strike or alarm.

Figure 14:
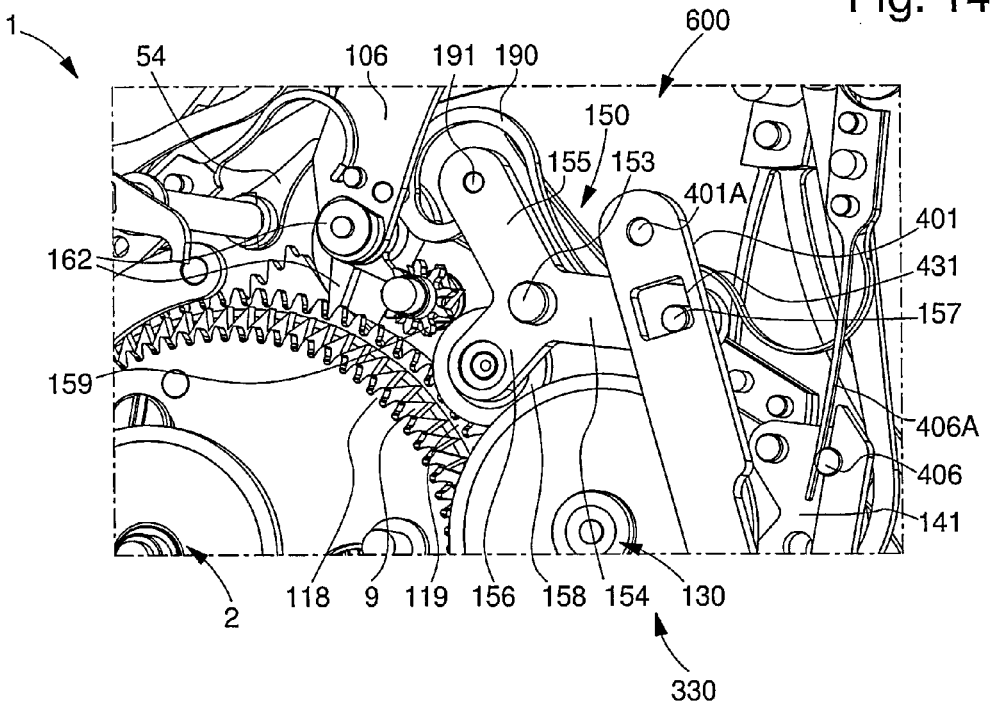
Figure 15:
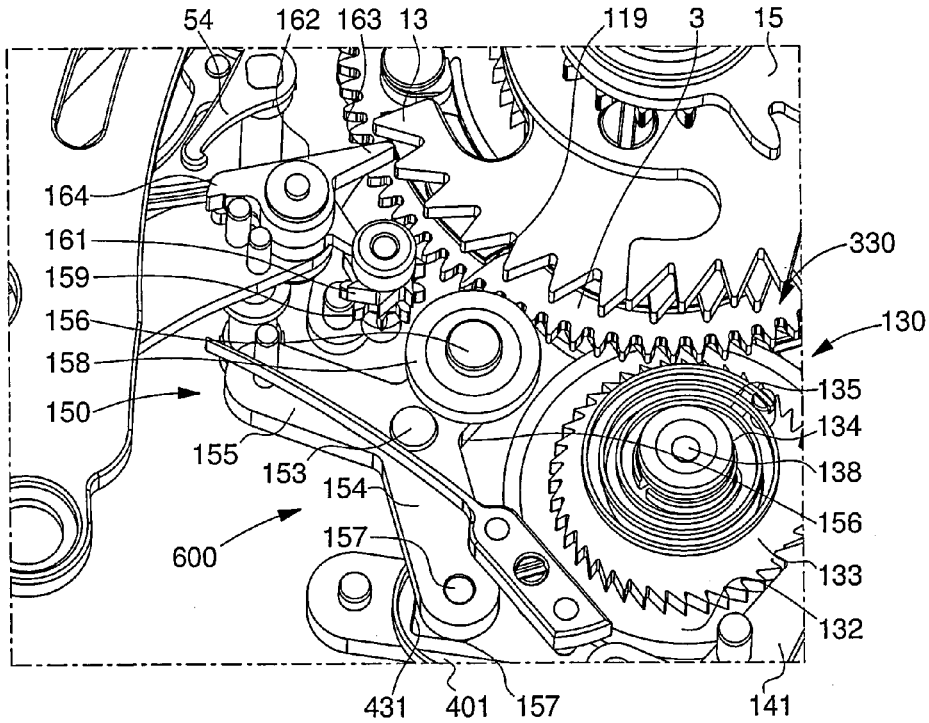
Figure 16:
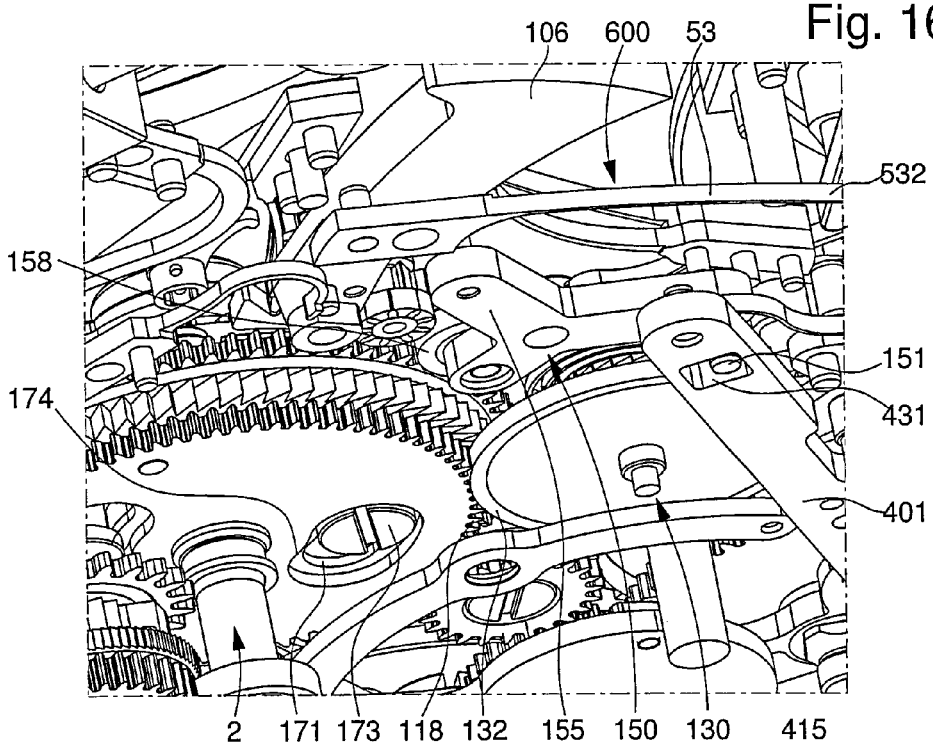

According to the invention, the alarm control mechanism 400 includes a coupling mechanism 600 arranged, when the secondary striking or alarm mode is selected, to play the secondary strike or alarm using the grand striking mechanism of timepiece 1000. Conversely, when the main striking mode is selected, this coupling mechanism 600 uncouples the secondary striking or alarm mechanism using the grand strike and, either does not play the secondary strike or alarm, or plays the secondary strike or alarm using a mechanism other than the grand strike, reserved for the display of the secondary striking or alarm mechanism, if the timepiece has such a mechanism, for example a vibrating device. In the preferred embodiment, illustrated in the Figures, this coupling mechanism 600, controlled by the large control device 401, includes a coupling wheel set 150, which is shown in FIGS. 14 to 16.

FIGS. 2, 3, 4 and 19 partially show a repeater striking mechanism 100 according to the invention. The conventional components of a grand strike or repeater striking mechanism, in particular a minute repeater, are not shown, since those skilled in the art may refer to the aforecited work "Les montres compliquées" to find the usual combinations.

Figure 4:
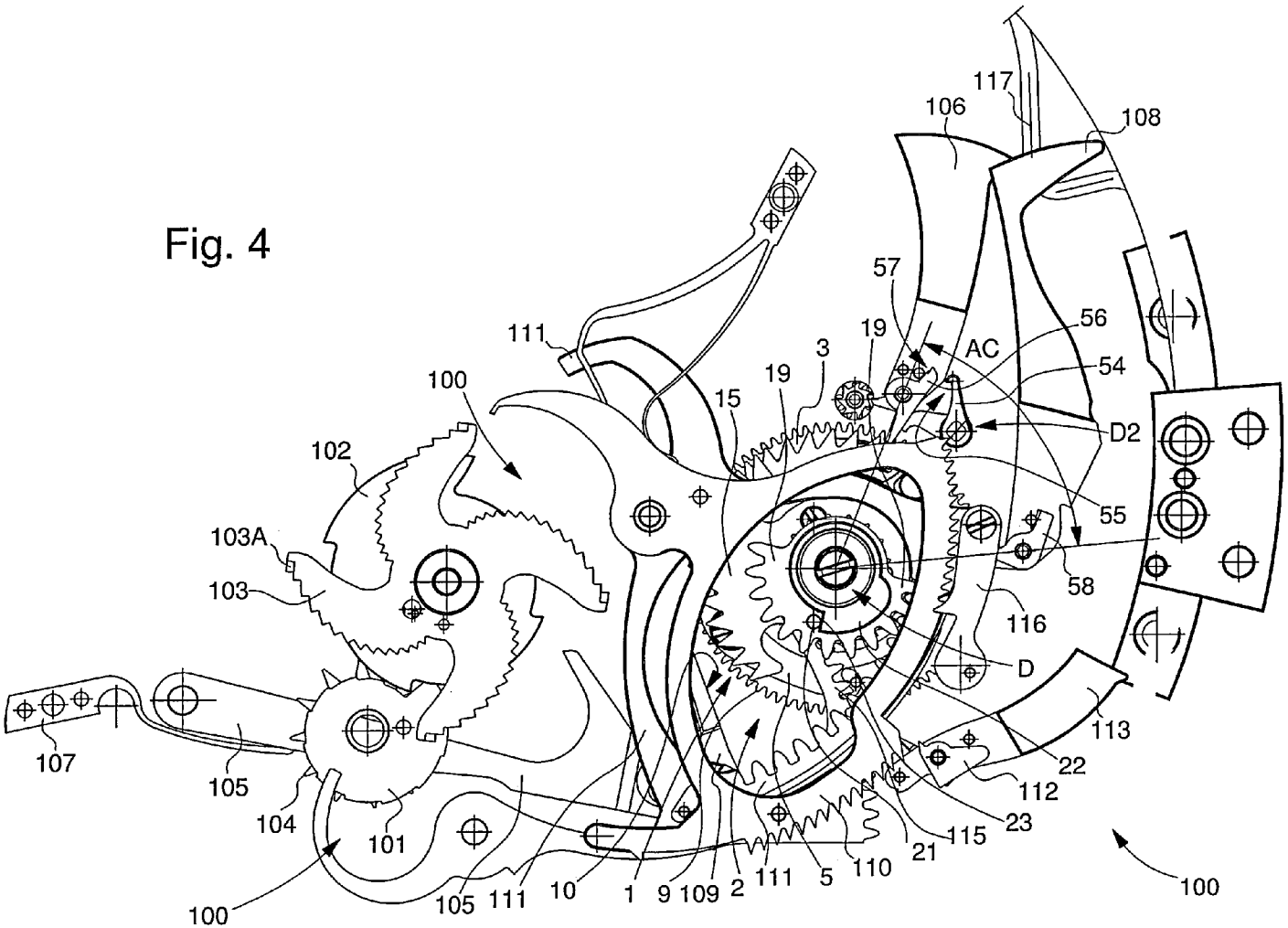
FIG. 4 shows a schematic partial view of the repeater striking mechanism of the timepiece of FIGS. 2 and 3, including a striking mechanism unit, according to the invention and illustrating the rack mechanism controlling the striking mechanisms.

The information gathering members of the striking mechanism are conventionally the hour-snail 101, quarter-snail 102 and minute-snail 103 with the surprise-piece 103A, seen in FIG. 4. A release lever 105, illustrated in detail in FIG. 17, is controlled by a control mechanism, such as a release cam or similar. Said lever 105 is returned by a spring 107 and includes a second first click 109. This second first click 109 is intended to cooperate with the detent ratchet 9, which is comprised in striking mechanism unit 2 and will be presented hereinafter.

The repeater striking mechanism 100 includes minute-rack 110 and quarter-rack 111, and, for the hour repeater, a first lifting piece 58 for driving a first hammer 108 against a gong 117. In a specific variant, a second lifting piece drives a second hammer 106. For the minute repeater another lifting piece 112 drives a small hammer 113. A rack 115 is used for winding the striking mechanism and is intended to cooperate with a rack pinion 14 comprised in striking mechanism unit 2. A minute hook 116 may be fixed to the quarter-rack 111 to limit the duration of the strike according the number of minutes and quarters to be struck, to prevent the mechanism from rotating idly between the quarters and minutes, the minute-rack 110 then always stops on the same rest position.

A striking mechanism 100 includes a drive means, which may or may not be distinct from that of the actual timepiece movement 200. This drive means is not described in detail here. It may take the form of a barrel, a spring or similar, in general powered by the action of the user on a rack push piece or similar. This drive means provides the energy necessary to operate the striking mechanism or mechanisms. It is represented here simply by a drive arbour 120 transmitting energy to the sound generating wheel sets of the striking mechanisms. This drive arbour 120 sets in motion a striking mechanism unit 2, which directly transmits the energy to one or several pivoting hammer lifting pieces, comprised in striking mechanism 100, to control, at a suitable moment, the strike of one or several hammers on gongs, bells or similar.

As will be set out in detail hereinafter, in a preferred embodiment illustrated in the Figures, the secondary strike release mechanism 1 includes a special release lever 105, peculiar to the invention, the pivoting travel of which is started, in automatic striking mode, towards a detent ratchet 9 of striking mechanism unit 2 by a release cam 530, driven by a motion work of timepiece movement 200, or in striking on demand mode towards ratchet 9 by a minute repeater rod linkage activated by a push piece 535 operated by the user. The cooperation of this release lever 105 with detent ratchet 9 occurs via a first click 109 comprised in release lever 105. This first click 109 is returned by a first spring 109A and has the function of cooperating with detent ratchet 9 for the grand strike and the other main striking mechanisms selected by mode selecting means 500.

According to the invention, as seen in FIG. 17, the release lever 105 includes a second click 209, returned by a second spring 209A and located in a parallel plane and distinct plane to that of first click 109, and which has the function of cooperating with a toothing of a secondary strike release wheel 118, particularly for an alarm, which is added to striking mechanism unit 2 for activating the alarm strike. The selection between the first click 109 and second click 209 is made by a stepped pivoting selector part 233 articulated with the control rod linkage 700, the motion of which is controlled by mode selecting means 500.

Indeed, as seen in FIG. 17, release lever 105 includes, at one end thereof, two clicks 109 and 209 in two parallel and neighbouring planes, each returned by a spring, respectively 109A, 209A. The first click 109A has the function of cooperating with detent ratchet 9 for the grand strike and the other strikes of the main striking mechanism selected by column wheel 500, whereas the second click 209A has the function of cooperating with the toothing of release wheel 118 to activate the secondary or alarm strike. The pivoting selector part 233 is stepped and thus has the function of selecting the appropriate click depending on the striking mode selected, and particularly, when necessary, the pivoting selector part 233 can release the beak of the second click 209 from the toothing of release wheel 118 of striking mechanism unit 2.

Figure 7:
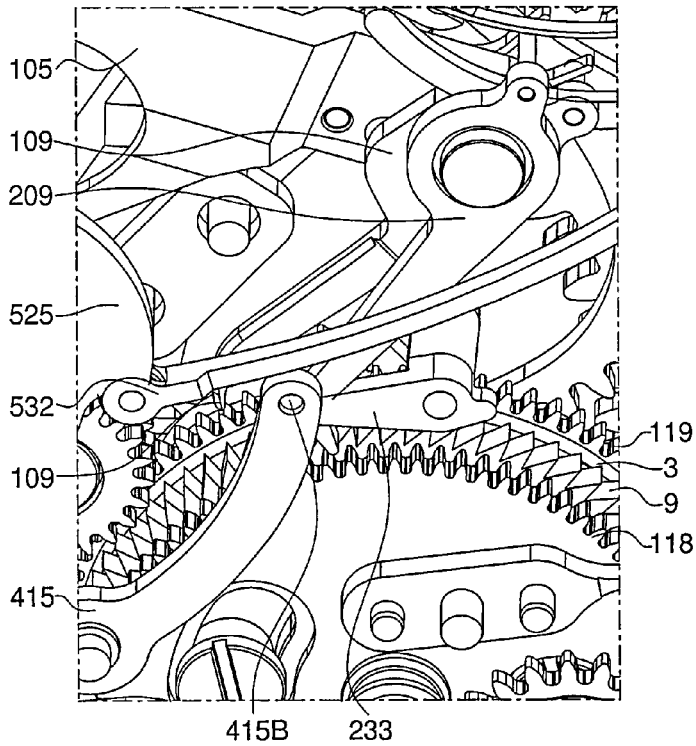
Figure 13:
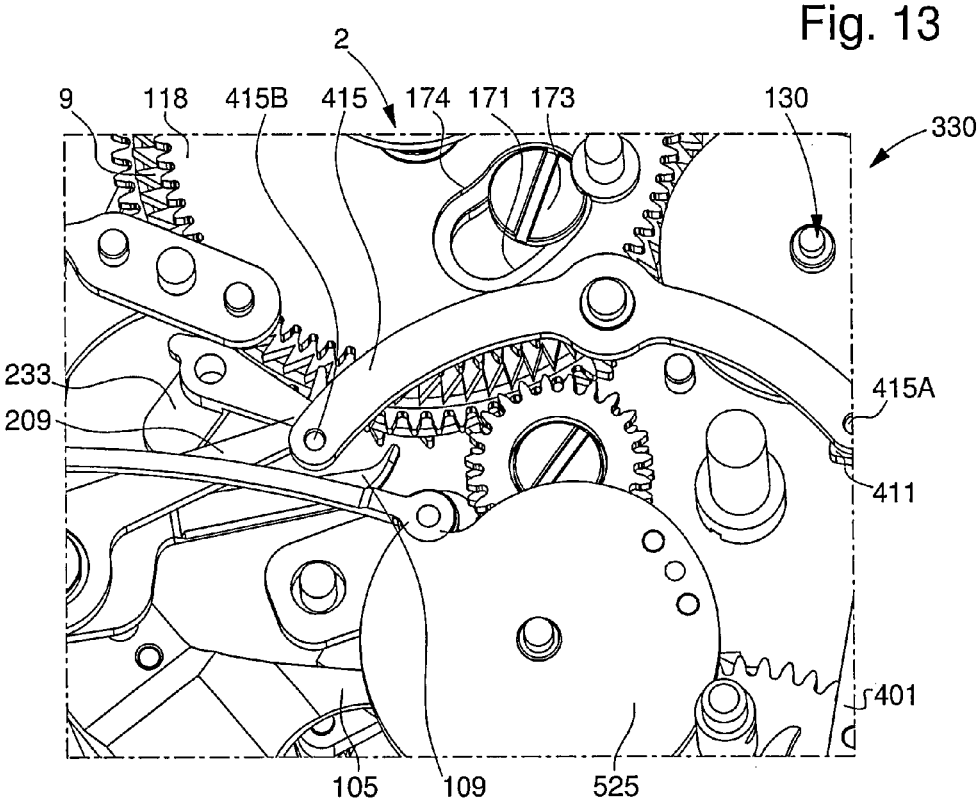

Thus, as it pivots, lever 105 releases, with one of the clicks 109 or 209 thereof, selected by a selection mechanism including a selector lever 415 and a pivoting selector part 233, respectively detent ratchet 9 or release wheel 118, as seen in FIGS. 7 and 13.

Figure 10:
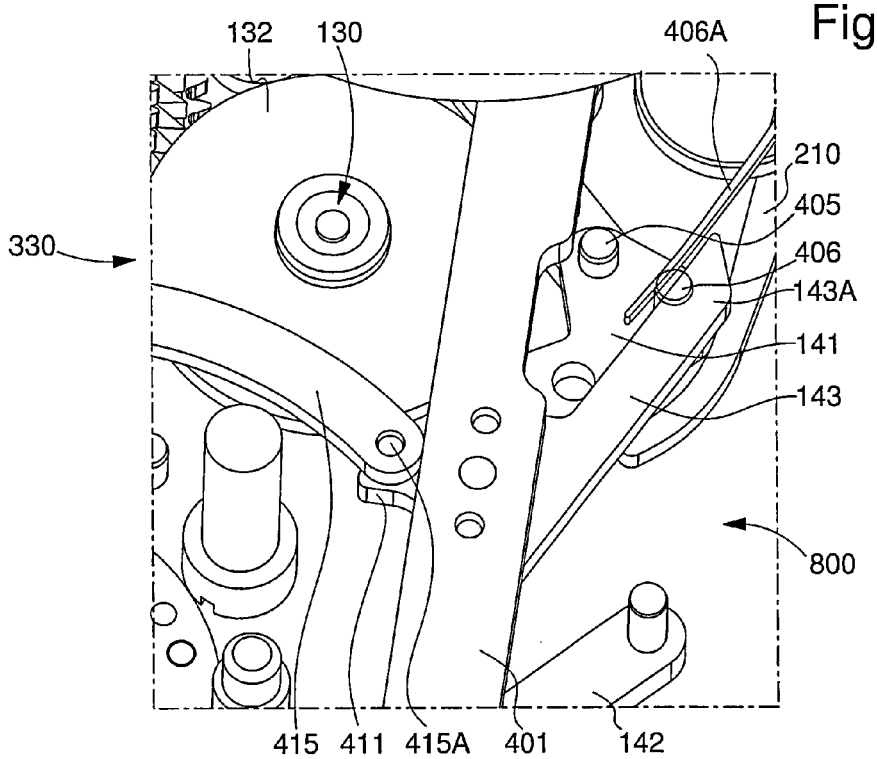
Figure 11:
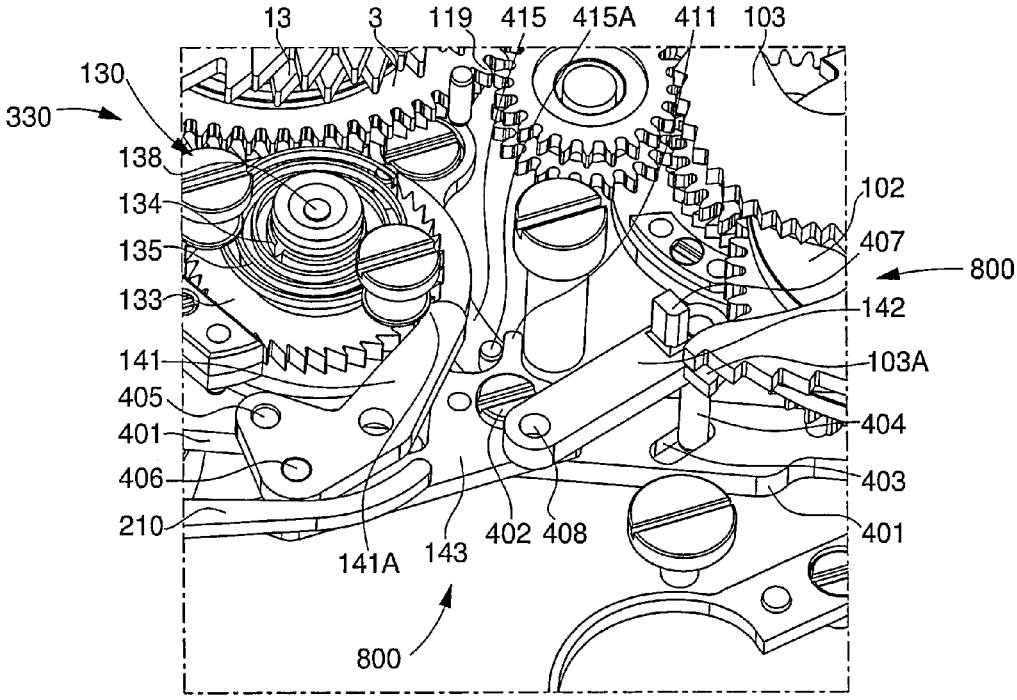
Figure 12:
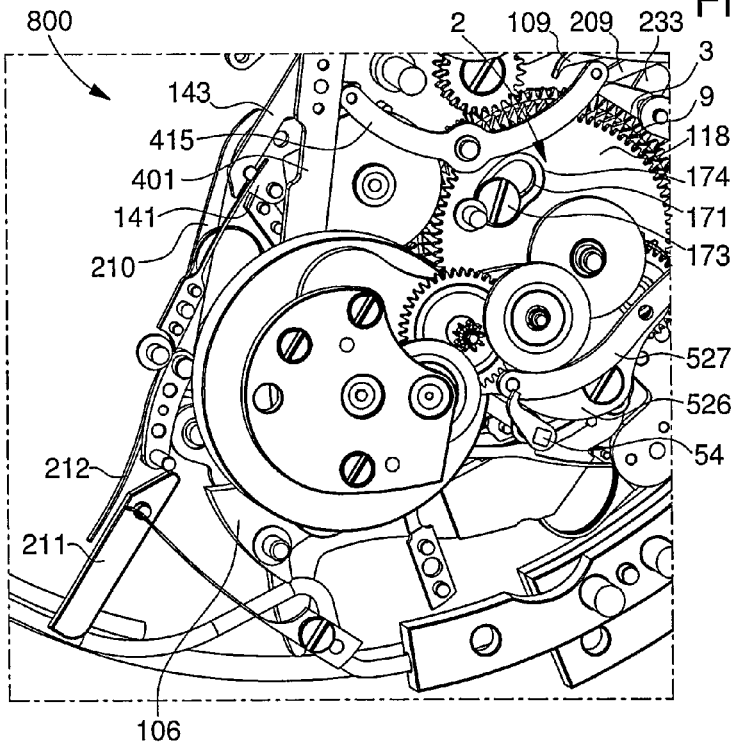

In order to achieve this, the large control device 401 includes a small arm 411 which projects sideways, relative to the rod linkage of the large control device 401. This small arm 411 has the function of driving a pin 415A mounted at one end of a selector lever 415, which is pivotally mounted at the middle thereof relative to the plate of the mechanism, as seen in FIGS. 10 to 12. As seen in FIG. 13, the other end of the selector lever 415 includes a pin 415B for the articulation thereof with the pivoting selector part 233, which is pivotally mounted relative to a plate or bridge of the timepiece.

The alarm release wheel 118 is independent of the detent ratchet 9 of striking mechanism unit 2, and juxtaposed therewith, each being able to act via a pin comprised therein, but never at the same time, on a hook 5 driving a pipe ratchet 11, conventionally comprised in striking mechanism unit 2. This pipe ratchet 11 is in turn integral with at least one ratchet 13 cooperating with at least one hammer lifting piece 58 to play a strike.

The mode selecting means 500 or a column wheel comprised in or forming said means, controls the pivoting of a hook 507 on a bridge. A first end of hook 507 cooperates with a ratchet 505 integral with mode selecting means 500 and a second end of hook 507 is arranged to drive the control rod linkage 700, in large control device 401 arranged to drive directly or indirectly via selector lever 415, the pivoting selector part 233 which makes the selection between the first click 109 and second click 209.

Figure 6:
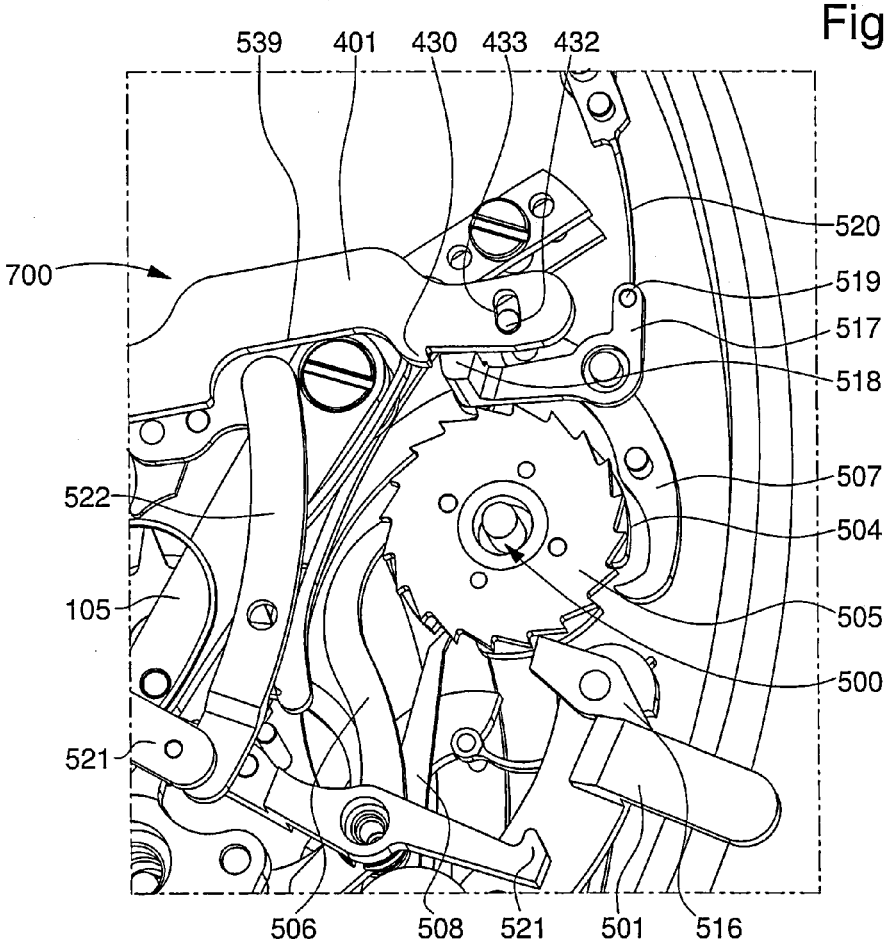

The three control members controlling the main striking mechanism and the secondary strike, particular the alarm strike, are:

- a mode selecting control finger 501 on a striking mechanism selector 500 forming mode selecting means 500, which here comprises a column wheel, visible in FIG. 6;
- a minute repeater release push piece, not directly shown here, which is returned to the rest position by a spring 534 and directly controls a first minute repeater lever 535;
- a manual push piece 211 for stopping the secondary or alarm strike, connected by a spring 212 to a manual lever 210 for stopping the secondary or alarm strike, explained hereinafter, and visible in FIGS. 2 and 3. This push piece 211 can stop the secondary or alarm strike before the end of the cycle of the secondary or alarm strike.

The user selects, via control finger 501, the desired operating mode of the striking mechanism. If he selects the secondary or alarm striking function, push piece 211 is made operative, otherwise it is uncoupled. The selection made on column wheel 500 is exclusively of a single mode, either the secondary or the alarm striking mode, or one of the main striking modes for which the striking mechanism 100 is devised, including the silent mode. Except for the silent mode, the minute repeater can theoretically be played at any time, but a safety device prevents the minute repeater starting when another strike of the main striking mechanism, or a secondary strike or alarm is playing, and vice versa. A specific safety device formed by a safety mechanism 900 set out hereinafter, and including a second pivoting lever 536 and a pivoting bolt 537, is arranged to make inoperative any triggering of the minute repeater, when the latter has already been triggered and is being played.

FIGS. 2 and 6 show a time-setting isolator 521 according to the teaching of EP Patent No 1 933 212 by the same Applicant incorporated herein by reference, which locks the time-setting mechanism when a striking mechanism is released.

In the alarm function, the coupling mechanism 600, via its control rod linkage 700, sets certain components in place, which, when the secondary striking or alarm mode is not selected, are isolated to give priority to the original main striking mechanism function. This control rod linkage 700 essentially includes the large control device 401, taking the form of a rod linkage shown in FIG. 18, and which cooperates directly or indirectly with components reserved for controlling operation of the secondary or alarm striking mechanism, to release the play of the secondary or alarm strike and to limit the duration thereof. These latter components are formed respectively in the preferred embodiment shown in the Figures by a coupling wheel set 150 and a timing hook 141 associated with a timing wheel set 130.

This large control device 401 also cooperates with safety members belonging to isolating means 800, notably a first isolator 142 for limiting the movements of feeler spindle fingers or racks, as will be explained hereinafter.

Figure 8:
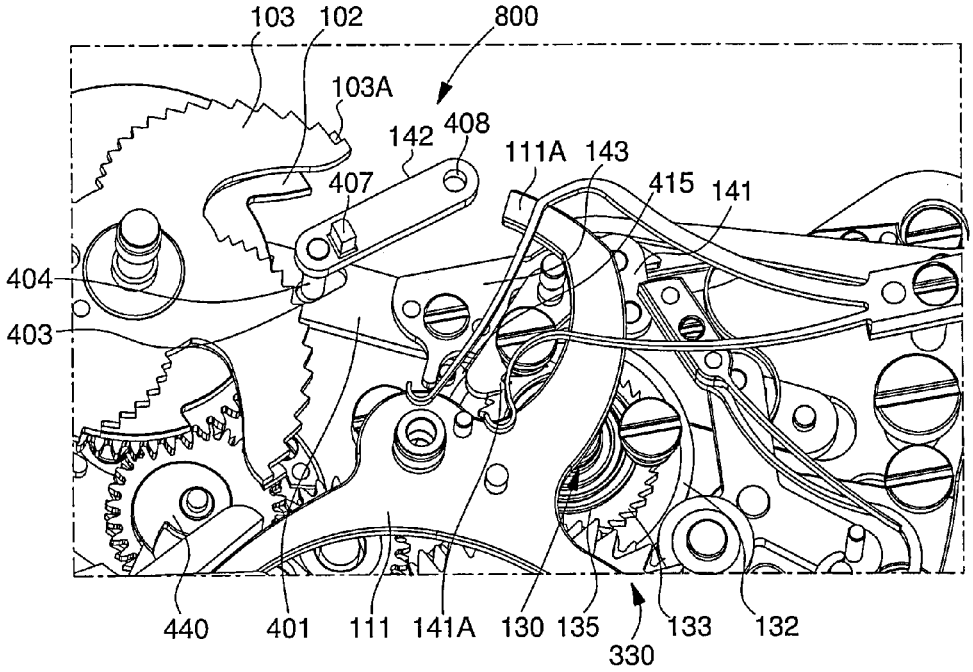
Figure 9:
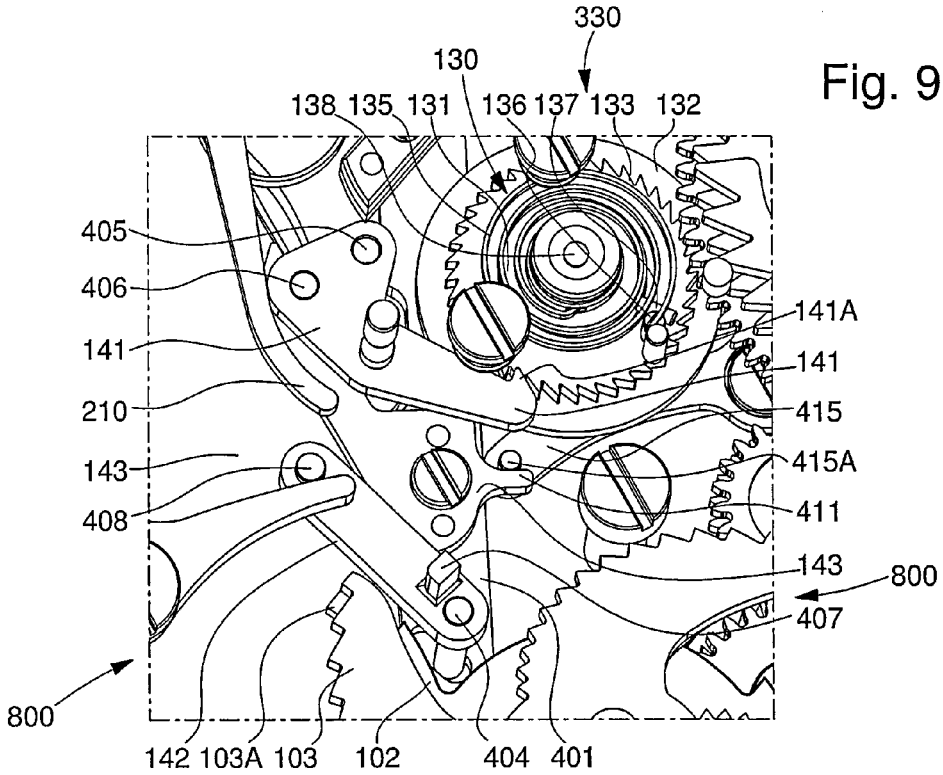

The large control device 401, seen in FIGS. 6 and 8, controls the grand strike to use part of the mechanism thereof to play the alarm, or conversely, to completely uncouple the alarm function from the striking functions. It governs all the parts of the alarm, a coupling function, and ensures the entire kinematics are properly in place. In the application thereof to a watch, the large control device 401 passes substantially diametrally through timepiece 1000, which allows direct action, with a minimum of intermediate wheels, between functions whose mechanisms are far apart. The large control device 401 can be made to be rigid, and it thus cooperates efficiently with the safety functions preventing any manipulations that are dangerous for the mechanisms.

The action of the user on the mode selecting control finger 501 starts the pivoting of column wheel 500.

As seen in FIGS. 3 and 6, in a particular and non-limiting example, the column wheel 500 includes four coaxial ratchets with four teeth, two of which are visible in the Figures, in opposite directions 502 and 503, it further includes a four leaf clover cam 504, and a ratchet 505 which cooperates with a hook 507 pivoting on a bridge (not shown).

As seen in FIG. 6, hook 507 includes a trunnion 432 or a pin, which is mobile in an oblong hole 433 in large control device 401 and a beak which cooperates with cam 504. The pivoting of column wheel 500 thus also causes the pivoting of hook 507, the trunnion 432 of which pushes large control device 401 via oblong hole 433.

In this particular embodiment, large control device 401 only moves between two positions, one of which corresponds to the winding of the secondary striking mechanism, particularly the alarm, for it to be played by the grand strike, and the other to the letting down of this secondary striking mechanism or alarm.

Ratchet 502 of column wheel 500 cooperates with a rack lever 512 one end of which includes a rack 513 for displaying the selected striking mode on a wheel 514 meshing with said rack 513 as seen in FIG. 3.

Ratchet 503 cooperates with an arm comprised in an hour isolator 506 for the small strike.

When the minute repeater is set in motion, the first minute repeater lever 535 pushes the second minute repeater lever 536, which causes an arm-lever 523 to translate, which in turn pivots a curved arm-lever 522, which is arranged to cooperate with a recess 539 of the large control device 401, as seen in FIG. 2. Arm 522 then pushes large control device 401, to isolate the alarm. Large control device 401 is then locked at the beak 430 thereof by the beak 518 of a lever 517, during the play of the minute repeater. Once the minute repeater has finished, lever 517 is disconnected, and then large control device 401 is returned to its place by the action of a return spring. The second lever 536 constitutes an efficient safety device against inadvertent manipulations by the user.

Figure 20:
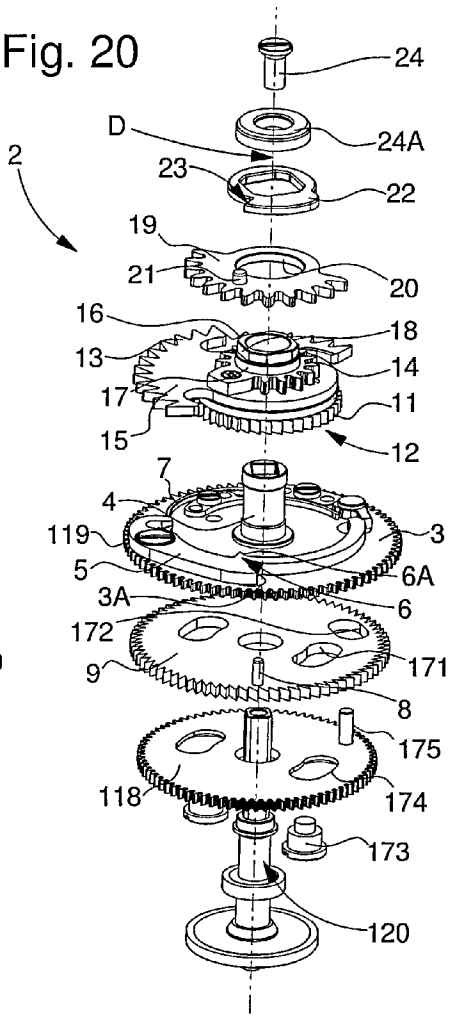
FIG. 20 shows a schematic, perspective, exploded view of a striking mechanism unit of the invention.
Figure 19:
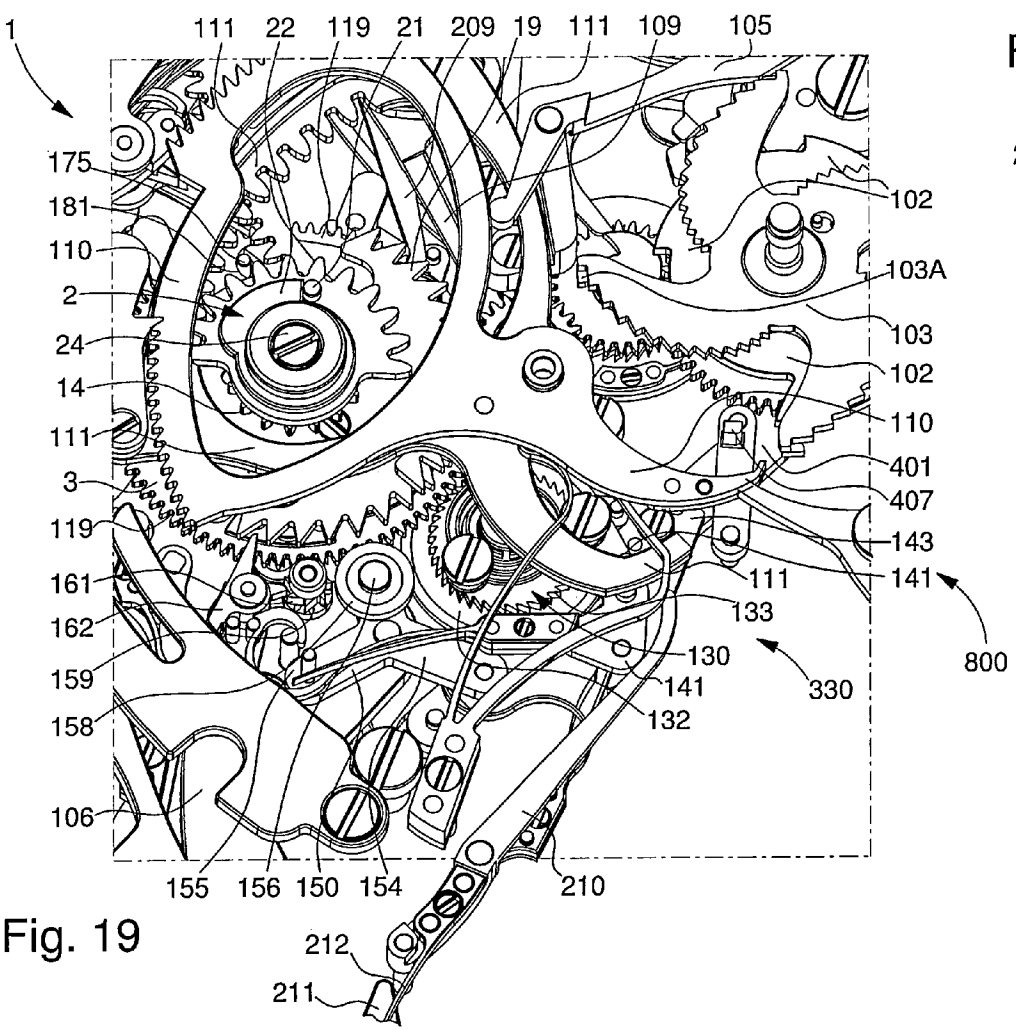
Figure 27:
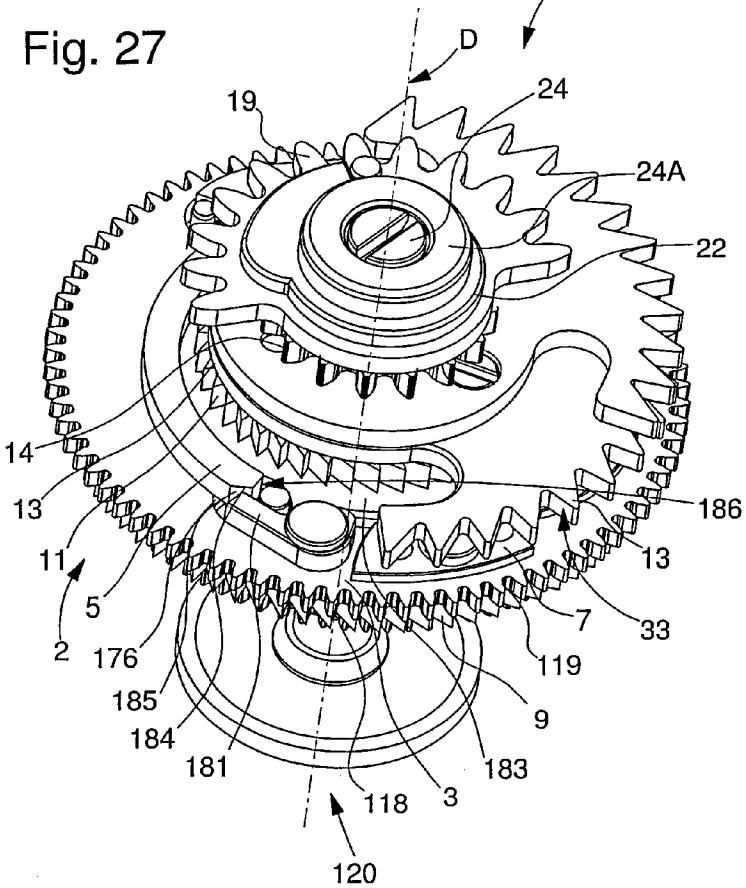
FIG. 27 shows a schematic, partial and perspective view of the assembled striking mechanism unit of FIG. 20.

The striking mechanism unit 2 as seen in FIGS. 20 and 27 is a special embodiment based on a conventional design. However, the invention can be adapted without difficulty to different compositions.

Figures 30, 31, 32, 33, 34, 35, 36, 37:
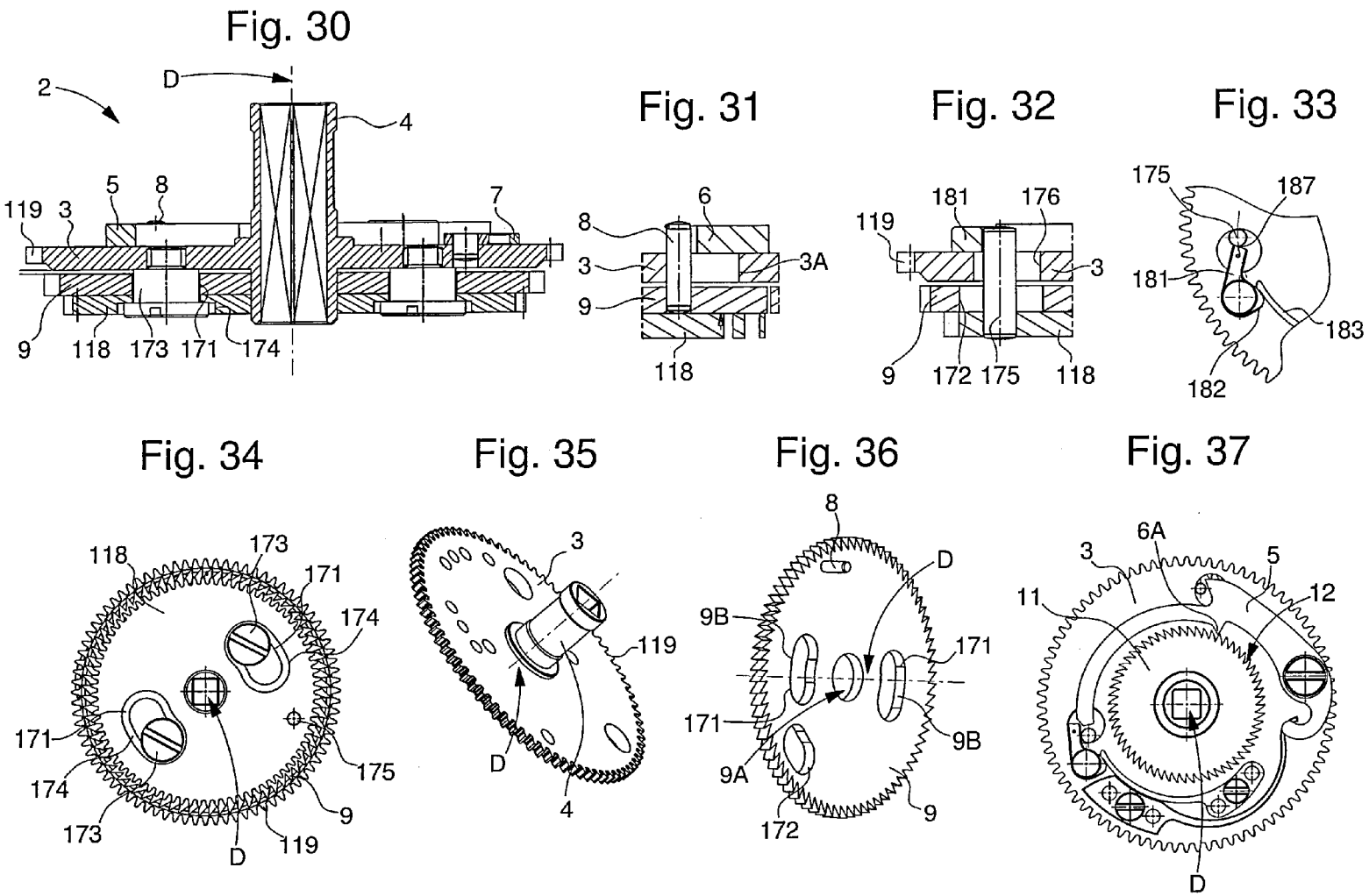
FIG. 30 shows a schematic view of the sub-assembly of the equipped drive plate in the cross section AA of FIG. 29.
FIG. 31 shows a schematic, partial view of the sub-assembly of the equipped drive plate in the cross-section BB of FIG. 29.
FIG. 32 shows a schematic, partial view of the sub-assembly of the equipped drive plate in the cross-section CC of FIG. 29.
FIG. 33 shows, in a similar manner to FIG. 29, a detail of another position of a locking stop comprised in the mechanism according to the invention.
FIG. 34 shows a schematic, plan, bottom view of the equipped drive plate of the sub-assembly of FIG. 28.
FIG. 35 shows a schematic, perspective view of a drive plate comprised in the equipped drive plate sub-assembly of FIG. 28.
FIG. 36 shows a schematic, perspective view of a detent ratchet comprised in the equipped drive plate sub-assembly of FIG. 28.
FIG. 37 shows a schematic, plan, top view of the principle of cooperation between a click hook comprised in the equipped drive plate sub-assembly of FIG. 28 with a pipe ratchet comprised in the striking mechanism unit and visible in FIG. 27.

This striking mechanism unit 2 includes a drive plate 3 with a pipe 4 pivotally mounted about a pivot axis D, shown in FIG. 35.

This drive plate 3 carries a click 5. Click 5 includes a hook 6 with a beak 6A returned towards axis D by a spring 7, as seen in FIG. 28.

Figure 28:
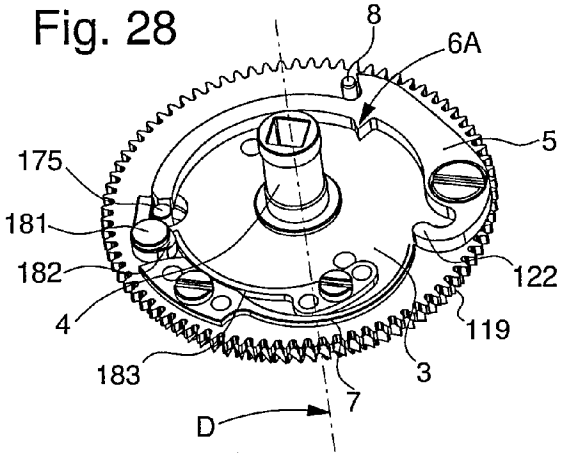
FIG. 28 shows a schematic, perspective view of a sub-assembly of an equipped drive plate comprised in said striking mechanism unit.
Figure 29:
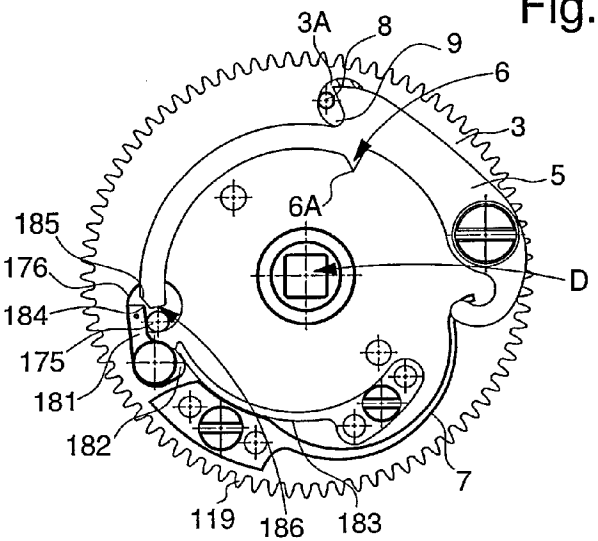
FIG. 29 shows a schematic, plan, top view of the sub-assembly of the equipped drive plate of FIG. 28.

FIGS. 28 and 29 show a specific equipped drive plate sub-assembly, peculiar to the invention, formed on the basis of the drive plate 3, carrying click 5, spring 7 and a pivoting stop 181 provided with a return spring 183, which are explained hereinafter.

Striking mechanism unit 2 includes a detent ratchet 9, which is arranged to cooperate with a main strike control mechanism 10, in particular to be driven by the second first click 109 of release lever 105.

Pipe 4 includes pivot drive means arranged to cooperate with a drive arbour 120 of a repeater striking mechanism 100.

The mechanism according to the invention can be used for a minute repeater, or for a grand strike, as shown in the Figures. In the usual manner for a grand strike, timepiece movement 200 drives snails 101, 102 and 103, which supply an exact time reference all the time.

In main striking mode, whether it occurs automatically or manually, the release of the strike causes the action of the first click 109 of release lever 105 on detent ratchet 9, causing said ratchet to pivot. Consequently, the pin 8 carried by said ratchet 9 moves in hole 3A in drive plate 3, and pushes hook 6 thus releasing toothing 12 of pipe ratchet 11, which, in the rest position of spring 7, was meshed with beak 6A of hook 6.

The output stage of striking mechanism unit 2 including hour ratchet 13 can then pivot freely about axis D. Due to the action of springs which cooperate with quarter-rack 111 and minute-rack 110, hour ratchet 13 is pivoted as a result of rack pinion 14, which is permanently driven by rack 115 until a rack arm stops on the hour snail 101.

The spring of quarter-rack 111 drives the pinion of quarter-rack 19 until an arm of quarter-rack 111 is stopped on quarter snail 102. The arm of minute-rack 110 takes its position on minute snail 103 in a conventional manner, via the movement of quarter-rack 111. When the striking mechanism is set in motion, pin 8 is released, and spring 7 again meshes beak 6A of hook 6 with toothing 12 of pipe ratchet 11, which activates the various lifting pieces on the respective hammers.

This detent ratchet 9, seen in FIG. 36, carries a pin 8, which can act, through a hole 3A comprised in drive plate 3 shown in FIG. 35, on click 5, to operate hook 6 by the action of a main strike control mechanism 10 or a release lever 105 or a first click 109 of lever 105 comprised in repeater striking mechanism 100.

This click 5 is thus mobile, preferably substantially radially, against spring 7, i.e. towards the periphery of plate 3, by the action of this pin 8.

As seen in FIG. 37, striking mechanism unit 2 includes a pipe ratchet 11, which is arranged to be pivotally mounted on pipe 4 of drive plate 3, about axis D. This pipe ratchet 11 is devised to cooperate, via a toothing 12 comprised therein, with the beak 6A of hook 6 of click 5, as seen in FIG. 37. Depending on its position, this beak 6A allows or prevents the pivoting of pipe ratchet 11.

Pipe ratchet 11 is mounted to pivot integrally about axis D with at least a first hour ratchet 13, which is arranged to cooperate with at least one lifting piece 58 for driving a hammer comprised in repeater striking mechanism 100 to release a main strike. In a particular variant, the first hour ratchet 13 is pivotally integral with a second hour ratchet 15, which is angularly shifted relative thereto, to release an additional strike, shifted in time relative to the basic strike, and in particular within certain time slots.

According to the invention, as seen in FIGS. 20, 27 and 30, striking mechanism unit 2 further includes a release wheel 118, in particular an alarm release wheel when the secondary strike is an independent alarm strike, for releasing a secondary strike, different from the main strike. The secondary strike may be played in particular, using the energy from the same drive means 120 as that used to operate the main striking mechanism, on at least one other gong, by the action of at least one other lifting piece on at least one other hammer, as illustrated in this particular preferred embodiment. This release wheel 118 is juxtaposed with detent ratchet 9, each being able to act on hook 6 via a pin, but never at the same time, to allow the transmission of energy to a sound mechanism to play, respectively, the secondary strike, or the main strike.

Indeed, release wheel 118 and detent ratchet 9 are independent of each other and each is controlled by different control means selected to start the play, respectively of the secondary strike or the main strike. Also, release wheel 118 and detent ratchet 9 are both arranged to cooperate, but never at the same time, on hook 6.

According to a preferred variant, release wheel 118 is arranged to cooperate with a timing wheel 132 comprised in a duration limiter timing wheel set 130, explained hereinafter, to regulate and limit the duration of play of the secondary or alarm strike. Preferably, the control rod linkage 700 and in particular the large control device 401, is arranged to lock timing wheel 132 at the end of the secondary or alarm strike cycle.

This timing wheel set 130 has the function of limiting the duration of the secondary or alarm strike to a predetermined value, for example to a duration of 20 seconds in the timepiece 1000 illustrated in the Figures.

According to another feature according to the invention, the drive plate 3 includes a peripheral toothing 119 arranged to cooperate with a coupling wheel set 150 carried by a control rod linkage 700 of a secondary strike release mechanism 1 corresponding to the other sound transmission called the secondary striking mechanism.

This peripheral toothing 119 enables the drive force from a grand strike mechanism to be used to drive a secondary striking mechanism, in the example of the Figures here an alarm striking mechanism. The example of the alarm is not limiting, other applications can be envisaged, such as driving an automaton or other mechanism.

More specifically, the striking mechanism unit 2 includes a drive plate 3, which includes a peripheral toothing 119 for cooperation with a pinion 158 comprised in a coupling wheel set 150 with which it is permanently meshed. This coupling wheel set 150 is angularly moved by a large control device 401 comprised in the control rod linkage 700, in order, depending on the position thereof, to make said pinion 158 cooperate or not cooperate with a pinion 159 carrying a star wheel 161, which is arranged to cooperate at least one lifting piece 162 for a hammer 106 to play the alarm strike.

Preferably, the striking mechanism unit 2 further includes a rack pinion 14, mounted to pivot integrally with hour ratchet 13 about axis D and visible in FIG. 27, arranged to cooperate with rack 115.

Figures 25, 26:
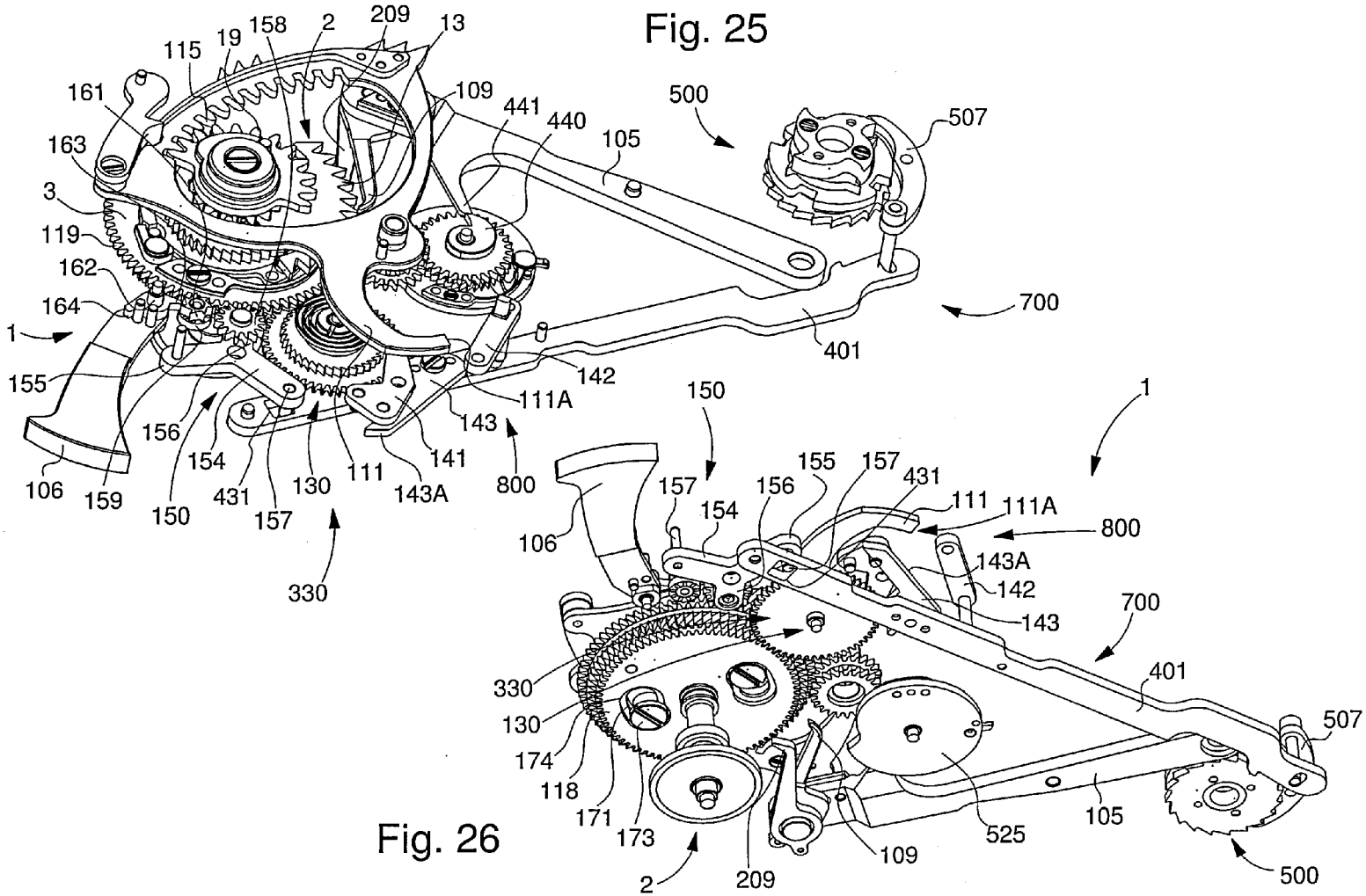
FIG. 25 shows a schematic, perspective view of a detail of the mechanism for starting the alarm strike via the grand strike according to the invention, and the cooperation between an isolator assembly, comprised therein, and a quarter-rack of the striking mechanism.
FIG. 26 is a reverse view of FIG. 25.

Preferably, the pipe 16 of pipe ratchet 11 includes a cylindrical shoulder 17 arranged to receive a quarter-rack pinion 19, which is pivotally mobile and comprised in striking mechanism unit 2, seen in FIG. 25. This pinion 19 is arranged to cooperate with a quarter-rack 111 of a striking mechanism 100 of this type and carries a pin 21. This pipe 16 includes pivot drive means 18, for example, in the form of a Kelly bushing or similar, for a finger 22 comprised in striking mechanism unit 2. This finger 22, seen in FIG. 27, includes a bearing face 23, which is arranged to cooperate with pin 21, to pivot pinion 19 when the quarter-rack 111 pivots in a single direction of pivoting able to drive finger 22.

Finger 22 is integral with or fixed to hour ratchet 13 via the female square thereof, and it allows pinion 19 to stop in a position which is only imposed by quarter-rack 111. The angular shift between bearing face 23 and pin 8 thus increases according to the number of hours to be struck, before the strike starts.

The assembly of striking mechanism unit 2 is achieved by a screw or similar 24, supported on a washer 24A and assembled with a drive arbour 120 or a wheel set carried thereby.

The pipe 4 of drive plate 3 preferably includes pivot drive means for example in the form of a female square or similar, arranged to cooperate with drive arbour 120 of repeater striking mechanism 100.

Drive plate 3 includes a hole 3A for the passage of pin 8 of detent ratchet 9 for operating hook 6, by the action of a main strike control mechanism 10 or a release lever 105 or a second first click 109 of lever 105 of this type, comprised in a repeater striking mechanism 100 of this type.

The release lever 105 of the grand strike repeater mechanism 100 abuts with the second first click 109 thereof on detent ratchet 9, inserted between drive plate 3 and alarm release wheel 118, and thus drives said detent ratchet 9.

Detent ratchet 9 is inserted between drive plate 3 and release wheel 118. As seen in FIGS. 30, 31, 34 and 36, the detent ratchet 9 includes oblong holes 171 in which screws 173 can move freely with a limited angular travel. Said screws are fixed to the face of drive plate 3 opposite the face carrying click 5.

This detent ratchet 9 further includes another oblong hole 172 which allows a pin 175, mounted on alarm release wheel 118, limited movement so as to limit the angular pivoting travel therebetween.

When release wheel 118 pivots relative to detent ratchet 9, pin 175 which carried thereby thus travels through an arc of a circle, limited by a travel limiting hole 176, comprised in drive plate 3, as seen in FIGS. 29 and 32, and this pin 175 is arranged to push one end 186 of click 5.

A locking stop 181 is pivoted on drive plate 3. It includes a cam 182, on which a spring 183 acts, tending to pivot stop 181 and to press a corner 184 thereof onto a slanting face 185 of click 5, which forms a ramp.

The action of spring 7 tends to return the inner beak 6A of click 5 onto pipe ratchet 11 of the downstream stage 1 and to lock said ratchet, except precisely when pin 175 describes an arc of a circle in its hole 176 and presses on a front end 186 of click 5 as seen in FIG. 29, which releases tooth 6A from pipe ratchet 11.

When pin 175 occupies the furthest position from the pivot of stop 181, stop 181 can tip, by the action of spring 183, and retain pin 175, via a flat portion 187 comprised therein, as seen in FIG. 33, and thus exert a locking action.

Once the striking mechanism is set in motion, stop 181 remains locked in abutment until it is unlocked at the end of the duration provided by the action of timing wheel 132 on release wheel 118, and timing wheel 132 will unlock said stop after the secondary or alarm strike has been played within the time period provided. Preferably this unlocking occurs before timing wheel 132 has completed three-quarters of a revolution when the strike has finished.

When the secondary or alarm striking mechanism is released, at a programmed time, by a secondary or alarm strike control mechanism 400, said mechanism 400 operates release lever 105 so as to pivot release wheel 118 of striking mechanism unit 2.

Manual operation of release lever 105 causes levers 523 and 522 to move. Said release lever 522 raises large control device 401. By the action of its spring, the lever with a beak 517 holds large control device 401 in this position, abutting on the beak 430 thereof. The lever with a beak 507 locks the lever with a beak 517 while the minute repeater is operating, if this is the case.

When the striking mechanism unit 2 in the main striking mechanism is operating, the pivoting of detent ratchet 9 thus results in an angular travel of its pin 8, which cooperates with click 5 pivoting on drive plate 3, and in the release of beak 6A of hook 6 from toothing 12 carried by pipe ratchet 11 of striking mechanism unit 2.

When the secondary striking mechanism is operating, the pin 175 integral with or fixed to alarm release wheel 118 drives the end 186 of click 5 and thus lifts the lever 6A of hook 6, the locking of the pin 175 by stop 181 thus allowing release wheel 118 to be suspended in a release position where it is a rest position release.

The invention advantageously includes an isolating mechanism 800, which is devised for any timepiece including, on the one hand, a timepiece movement 200 and, on the other hand, at least one striking mechanism including feeler spindles for gathering time information, on time references driven by said timepiece movement 200. According to the invention, this isolating mechanism 800 includes at least a first isolator 142, arranged to cooperate with a control mechanism comprised in said timepiece 1000, so as to take a stop position preventing the time information gathering feeler spindles from searching for information on the time references, in a first winding position, and to allow the feeler spindles to pass and come into contact with the time references, in a second let down position.

More specifically, this isolating mechanism 800 is arranged to isolate timepiece mechanisms for releasing various acoustic signals at least partially by using the same striking or grand strike or minute repeater mechanism 100 to play the acoustic signals; in particular, where at least one mechanism is a main strike control mechanism 10 arranged to release a main strike at times programmed by a timepiece movement 200 or on demand, and wherein the sequence of each striking mechanism is determined by the search for information, by feeler spindles gathering temporal information on time references driven by timepiece movement 200; and wherein at least one other of these mechanisms is a secondary strike control mechanism 400. This timepiece 1000 further includes a secondary strike release mechanism 1 including a coupling mechanism 600 arranged to allow the exclusive operation, at a given moment, either of a single secondary strike control mechanism 400, or a single main strike control mechanism 10.

According to the invention, the isolating mechanism 800 includes at least said first isolator 142 arranged to cooperate with said coupling mechanism 600 and, when wound by a secondary strike control mechanism 400, arranged to take a stop position preventing the time information gathering feeler spindles, comprised in the main strike control means 10, from searching for information on the time references while the secondary strike control mechanism 400 is operating, and conversely, to allow said feeler spindles to pass and come into contact with the time references when the secondary strike control mechanism 400, for example an alarm mechanism 400 in the example in the Figures, is let down and the main strike control mechanism 10 is operating.

The isolating mechanism 800 further includes a stop member formed by a timing hook 141 carried by the same large control rod linkage 401 as said first isolator 142, and which is pivotally mounted on the large control rod linkage 401 and which participates in limiting the travel of the time information gathering feeler spindles.

The control rod linkage 700 controls the isolating mechanism 800, which includes at least a first isolator 142 directly or indirectly controlled by a large control device 401 activated by mode selecting means 500, to take a stop position preventing the information gathering feeler spindles, comprised in the main strike control means 10, from searching for information on the time references driven by timepiece movement 200 when the secondary or alarm strike control mechanism 400 is operating to actuate the secondary or alarm strike, and to allow said feeler spindles to pass and come into contact when the secondary or alarm strike control mechanism 400 is let down and the striking or grand strike mechanism 100 is operating.

Thus, the release wheel 118 is released, but the racks of rack assembly 115 of the quarter-rack 11 and minute-rack 110 cannot gather information from their respective hour snail 101, quarter snail 102 and minute snail 103, since they are prevented by stop members or bolts formed by a timing hook 141 and by an isolating mechanism 800, which includes a first isolator 142 for locking the racks. This timing hook 141 and the first isolator 142 are controlled by large control device 401, as seen in FIG. 8, and by an hour brake lever of the small strike mechanism 506 seen in FIGS. 2 and 3. The first isolator 142 preferably includes a boss 407 intended to form an obstacle in various planes parallel for the time information gathering feeler spindles, particularly for the racks or fingers.

Consequently, drive plate 3 starts to pivot, but, since finger 6A of hook 6 is locked in the air, it cannot drive the grand strike counting parts. However, as explained hereinbefore, the peripheral toothing 119 of drive plate 3 drives pinion 158, mounted on an arm of a coupling wheel set 150.

In the embodiment illustrated in FIG. 14, which is in no way limiting, the coupling wheel set 150 includes three arms, so as to allow access to other components. One of these three arms 156 carries the pinion 158 which permanently cooperates with the toothing 119 of drive plate 3.

A second arm 154 carries a pin 157, which can move in an aperture 431, which is substantially square here and comprised in large control device 401, whose position thus determines the angular position of coupling wheel set 150. The third arm 155 carries a pin 191 used for attaching a return spring 190.

In one of the coupling positions of coupling wheel set 150, pinion 158 meshes with another pinion 159, mounted to pivot integrally with a star wheel 161. This star wheel 161 controls the movement of at least one lifting piece 162 to sound the alarm strike by activating a hammer 106, at a speed determined by the number of branches of star wheel 161.

As this movement is being performed, a timing control member called timing wheel set 130 is activated. This timing wheel set 130 for a timepiece mechanism, is devised for limiting the duration of play of a function after the start thereof, and is arranged to cooperate with a release element, the start of motion of which initiates the release of said function. It is further arranged to cooperate with a means 600 of coupling said function. According to the invention, the timing wheel set 130 includes a timing hook 141 arranged to be operated by said coupling means 600 to cooperate with a ratchet 133 or to be disengaged from ratchet 133. This ratchet 133 is pivotally mounted on an arbour coaxially with a timing wheel 132 towards which it is returned by pivoting towards an angular position of said timing wheel 132 by elastic return means 135. This timing wheel 132 is arranged to cooperate, directly or indirectly, with said release element.

Figure 24:
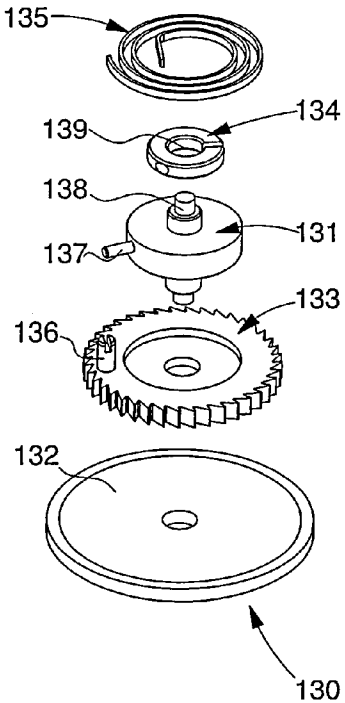
FIG. 24 shows a schematic, perspective, exploded view of a timing wheel set according to the invention.
Figure 23:
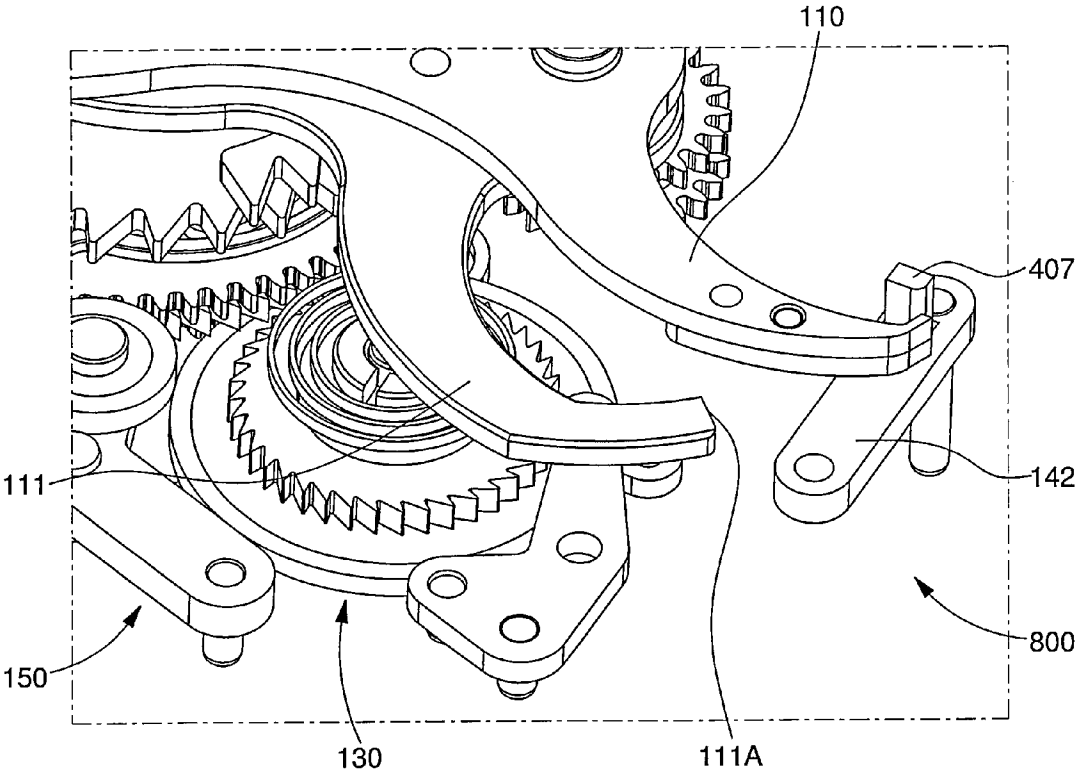
FIG. 23 shows a schematic, perspective view of an isolator mechanism according to the invention.

This timing wheel set 130, shown in FIG. 24, can adjust the duration of a signal, in particular here the duration of the alarm strike. It can be used for any desired timing in the timepiece, or for applications derived from horology, such as an explosive timing device or other device.

The invention concerns a mechanism 330 for limiting the duration of a timepiece function of a timepiece mechanism, including a release element, the start of motion of which initiates the release of said function, and further including a means 600 of coupling said function. According to the invention, said duration limiting mechanism 330 includes a timing wheel set 130 of this type for limiting the duration of play of said function after the start thereof, said timing wheel set 130 being arranged to cooperate with said release element, and further arranged to cooperate with said coupling means 600.

According to the invention, this release element is formed by a release wheel 118 of a release wheel set or striking mechanism unit 2.

This release wheel 118 includes, as seen in FIG. 32, a pin 175 parallel to the axis thereof. The release wheel, or striking mechanism unit 2 as in the application illustrated by the Figures, includes locking means 181 on which there are exerted, in an antagonistic manner, the forces exerted on the one hand by the pin 175 of the release wheel 118 which meshes with the timing wheel 132, and on the other hand, a spring 183, as seen in FIG. 29.

In a first pivoting travel of timing wheel 132 relative to timing ratchet 133, the return force exerted by said elastic return means 135 via pin 175 on locking means 181 is less than the force exerted on said locking means 181 by spring 183 to allow the function to be carried out, driven by a pipe ratchet 11 connected to drive means 120. Whereas, in a second pivoting travel of timing wheel 132 relative to timing ratchet 133, the return force exerted by the elastic return means 135 via pin 175 on locking means 181 is greater than the force exerted on locking means 181 by spring 183 and allows a movement of pin 175 to release the closing movement of a click 5 on pipe ratchet 11 to stop performance of the function concerned.

This ratchet 133 includes stop means 136 arranged to cooperate, in a let down position of timing wheel 130, by abutting on complementary stop means 137 integral with or fixed to timing wheel 132. This stop means 136 and complementary stop means 137 are moved away from each other by the movement of the release element which drives timing wheel 132 by winding elastic return means 135 when ratchet 133 is prevented from pivoting by timing hook 141.

This timing wheel set 130 includes a timing wheel 132 meshing with release wheel 118. A plate 131, one shaft end of which is driven onto timing wheel 132, and a timing ratchet 133 are mounted coaxially to said timing wheel 132. This timing ratchet 133 is captive between plate 131 and timing wheel 132, but free to pivot relative to said plate and wheel. Timing ratchet 133 includes a pin, forming the stop means 136, mounted parallel to the pivot axis, in order to interact with a radial pin, forming the complementary stop means 137 comprised in plate 131.

Pin 136 of timing ratchet 133 is also used for hooking one end of a spiral spring, forming elastic return means 135, the other end of which is carried by a stop 134, a bore 139 of which cooperates with another shaft part 138 of plate 131.

Timing ratchet 133 cooperates with the timing hook 141 which is preferably jointed with the large control device 401, and which retains the timing ratchet 133, as seen in FIG. 11.

In the particular application illustrated in the Figures, the duration limiting mechanism 330 forms a wheel set for limiting the duration of operation of the strike, and the release wheel 118 belongs to a striking mechanism unit 2, including a drive plate 3 with a pipe 4 pivotally mounted about a pivot axis D, said drive plate 3 carrying click 5 including a hook 6 with a beak 6A returned towards axis D by a spring 7. This click 5 can move against spring 7 by the action of a pin 8 of detent ratchet 9, which is comprised in striking mechanism unit 2 and which is arranged to cooperate with a main strike control mechanism 10. The striking mechanism unit 2 including said pipe ratchet 11 is arranged to be pivotally mounted on a pipe 4 about axis D and to cooperate, via a toothing 12 comprised therein, with said beak 6A which, depending on the position thereof, allows or prevents the pivoting of pipe ratchet 11. This pipe ratchet 11 is mounted to pivot integrally about axis D with a first hour ratchet 13 arranged to cooperate with a first lifting piece for driving a hammer of a striking mechanism. Release wheel 118 is independent of detent ratchet 9 and controlled by control means other than this main strike control mechanism 10, and the release wheel 118 and detent ratchet 9 are both arranged to cooperate, but never at the same time, on hook 6, to allow the transmission of energy to a sound mechanism for generating, respectively, different sound transmissions.

In this duration limiting mechanism 330, the locking means 181 is preferably formed by a locking stop which pivots on the drive plate 3. This stop 181 carries a cam 182, acted on by a spring 183, which tends to pivot stop 181 and to press a corner 184 thereof onto a slanting ramp surface 185 of click 5. The action of spring 7 tends to return and lock the inner beak 6A of click 5 onto pipe ratchet 11, except when pin 175 describes an arc of a circle in a hole 176 in drive plate 3, and presses on a front end 186 of click 5 to release tooth 6A from pipe ratchet 11. When pin 175 occupies the furthest position from the pivot of stop 181, stop 181 tips by the action of spring 183 to retain pin 175, via a flat portion 187 thereof, and thus exerts a locking action.

Figure 22:
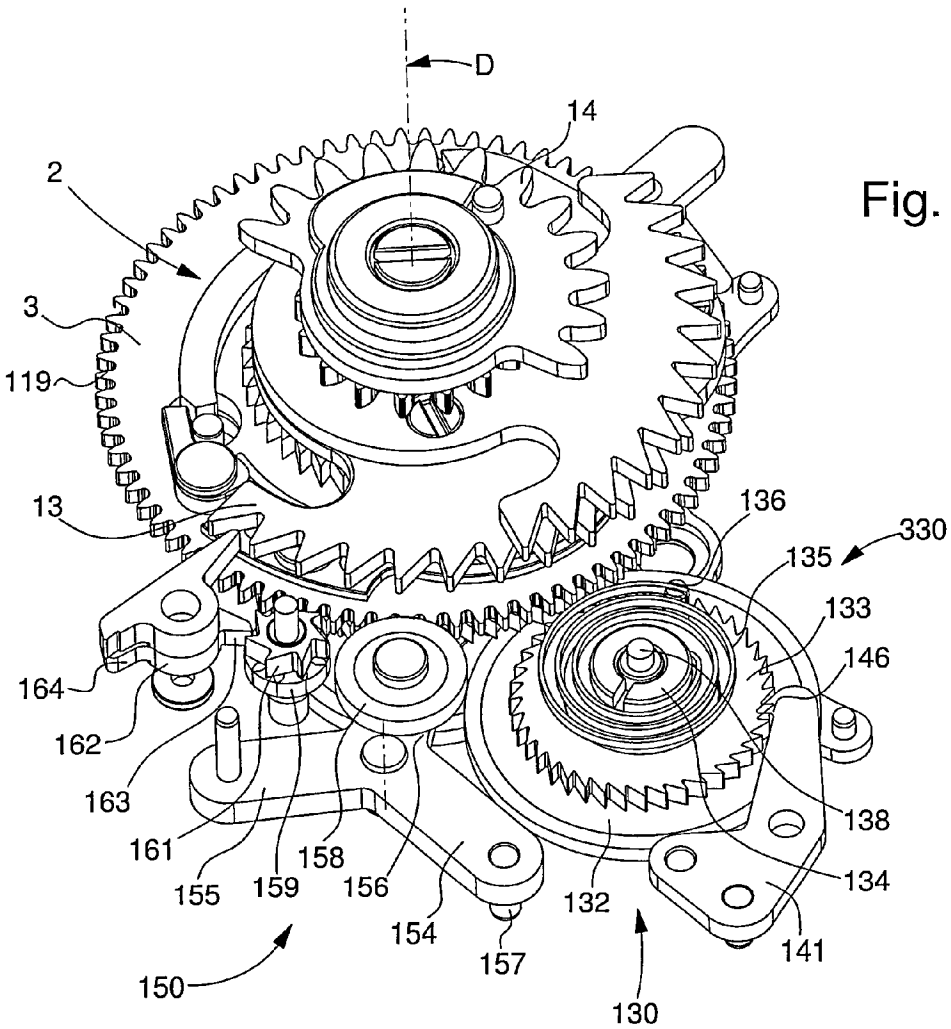
FIG. 22 shows a schematic, perspective, partial view of a mechanism for starting the alarm striking mechanism via the grand strike according to the invention, including mobile control members activated by a large control device which is not shown in this view, a coupling wheel set, a timing wheel set, the striking mechanism unit according to the invention and a hammer for playing the alarm striking sound.

When the alarm release wheel 118 of striking mechanism unit 2 drives timing wheel 132 in the anti-clockwise direction in FIG. 22, and thus drives plate 131, the spiral spring 135 is wound since timing hook 141 then locks ratchet 133. The radial pin 137 for the minimum retaining of plate 131, which was abutting on pin 136 of timing ratchet 133, leaves said ratchet and describes an angular travel. This angular travel is preferably limited to 270°; at this stage the force exerted by spiral spring 135 balances the locking force of the bolt of hook 5.

In the alarm function, the timing hook 141 holds ratchet 133 so as to exert a torque on drive plate 3 in order to overcome the force of spring 183 and enable locking stop 181 (seen in FIG. 29) to be placed in the rest position. Spiral spring 135 is calibrated as a function of said spring 183. Thus, when the winding of spiral spring 135 is greater than the force of spring 183, pin 175 of alarm release wheel 118 pushes back locking stop 181, which releases hook 5, which then hooks pipe ratchet 11 of timing wheel set 2 and returns the assembly to rest after several degrees of pivoting. The strike is then stopped.

When hook 141 is released, ratchet 133 pivots to return to its standby position, where pin 136 is abutting on pin 137 of plate 131. The timing wheel set 130 rotates freely if hook 141 is raised.

Timing hook 141 carries a pin 405, seen in FIG. 10, which is arranged for locking timing wheel 132 so as to force the release lever. In manual operation, the wheel can thus be locked to short-circuit timing wheel set 130.

Timing hook 141 is then set free, and it returns to the ratchet and releases striking mechanism unit 2. Timing hook 141 hooks alarm release wheel 118 again and drives the grand strike assembly through a few more degrees so as to return the various racks to the rest position.

Thus, all of the parts are in the rest position and timing hook 141 releases timing ratchet 133 returning to the rest position by the action of spring 135. During this time, the pivot 405 of timing hook 141 on large control device 401 interacts with the toothing of the timing wheel 132 and locks said wheel.

The activation or deactivation of the secondary or alarm striking function involves operating large control device 401. When the secondary or alarm striking function is deactivated, this large control device 401 acts on coupling wheel set 150 of coupling mechanism 600. The large control device 401 thus acts on coupling wheel set 150, by moving pinion 158, as appropriate, either away from or closer to pinion 159, which carries star wheel 161.

The first isolator 142, which is pivotally mounted on a pivot 408 on a bridge (not shown), then leaves the trajectory of quarter-rack 111 and timing hook 141 is held in the air.

The cycle of the various striking mechanism can then continue, and selector lever 415 can select one of the two clicks 109 or 209.

Thus, the invention uses all or part of the grand strike mechanism to achieve the acoustic display of the secondary or alarm striking function.

The first isolator 142 is mobile, on a trunnion 404 comprised therein, in a groove 403 comprised in large control device 401, arranged obliquely relative to the longitudinal direction of said device, as seen in FIG. 11.

This first isolator 142 carries a projecting boss 407, arranged to create an obstacle in the path of the racks of the quarter-rack 111 and minute-rack 110, and as seen in FIG. 8, to therefore prevent said racks from coming into contact with quarter snail 102 and minute snail 103 respectively. Thus, this first isolator 142 does not prevent the striking mechanism from operating as an acoustic signal generator, but prevents it from operating under the control of quarter-rack 111 and minute-rack 110. The strike hammer mechanism can thus generate an alarm strike.

The movement imparted to large control device 401 allows the timing hook 141 to be moved forwards or backwards. A groove 403 arranged in large control device 401 allows the first isolator 142 to be pivoted. At one end of large control device 401, an aperture 431 allows coupling wheel set 150, shown in FIGS. 14 to 16, to pivot. Wheel set 150 includes an arm 154 provided with a pin 157 which is movable in said aperture 431.

The control rod linkage 700 controls isolating mechanism 800, which preferably includes at least a second isolator 143 directly or indirectly controlled by a large control device 401, activated by mode selecting means 500, to place in or out of operation, depending on the position thereof, a timing hook 141, which cooperates with a timing ratchet 133 comprised in a timing wheel set 130, arranged to adjust the duration of a secondary or alarm strike signal, controlled by secondary strike control mechanism 400.

Thus, the mechanism includes another second isolator 143, which is seen in FIGS. 8 to 11 and is integral with or fixed to large control device 401. This second isolator carries a large arm 143A, with projects obliquely relative to the longitudinal direction of large control device 401, seen in FIG. 10, and which has the function of placing timing hook 141 in or out of operation, depending on the position thereof. Timing hook 141 is returned by a spring 406A seen in FIGS. 10 and 14, and the large arm 143A abuts on a pin 406.

The duration limiting mechanism 330 advantageously includes a lever 210, seen in FIG. 10, which is linked, via a spring 212, to a push piece 211 to stop the strike manually, in particular the alarm strike in this preferred application, and which is arranged to pivot timing hook 141, to unhook timing hook 141, so as to unlock timing wheel 132 when a user acts on push piece 211. To unhook timing hook 141, lever 210 is arranged to cooperate with a rounded edge of timing hook 141, underneath arm 143A, which also acts as a guide surface for said lever 210, which is very long. The action on push piece 211 then unlocks timing wheel 132, via lever 210 and timing hook 141, which lever 210 then pivots.

In a non-limiting embodiment of the invention, which allows the small arm 411 of large control device 401 to be arranged in an off-centre plane relative to that of large control device 401, said small arm is integrated in second isolator 143 and projects laterally, on the opposite side to that of large arm 143A, relative to large control device 401.

Preferably, when the striking or grand strike or minute repeater mechanism 100 includes a minute repeater mechanism that can be activated by the user by pressing on a push piece which pushes a first minute repeater control lever 535, mechanism 1 includes a safety mechanism 900.

This safety mechanism 900 is devised to protect against inadvertent operation of the minute repeater and is designed for a timepiece 1000 which includes a timepiece movement 200, which in turn includes a motion work driving a release cam 530. In automatic mode, this cam 530 causes a release lever 105 to pivot towards a detent lever 9 comprised in a striking mechanism unit 2 of a striking mechanism 100 of this type including a minute repeater. This striking mechanism unit 2 is arranged, when a strike is actuated, to drive a plate 525 carrying a winding cam 440.

According to the invention, this safety mechanism 900 is arranged to cooperate with this first lever 535. It includes a second pivoting safety lever 536, the pivoting of which is controlled by first lever 535 when the minute repeater is set in motion. This second lever 536 includes a catch 536A which is arranged to cooperate with a finger 537A comprised in a pivoting bolt 537 returned by a spring, to prevent the minute repeater being released again once it has been set in motion. Bolt 537 is only released at the end of the time display striking cycle by the minute repeater.

This safety mechanism 900 is formed of two parts:

- the user interface, formed by this minute repeater release push piece, returned to the rest position by a spring 534 and directly controlling a first minute repeater lever 535;
- an intermediate push piece, connected to the release element of the striking mechanism, which includes a second safety lever 536 for release of the strike, arranged to cooperate with first lever 535.

The first lever 535 controls the pivoting of the second lever 536 when the minute repeater is set in motion. As seen in FIG. 21, the second lever 536 includes, on the one hand a catch 536A, which is arranged to cooperate with the finger 537A of a pivoting bolt 537, returned by a spring, so as to prevent the minute repeater from being released again once it has been set in motion, and on the other hand a beak 536C, which has the function of disconnecting a minute brake lever (not shown here). Pressing manually on the push piece causes second lever 536 to pivot and tends to release the safety devices to allow the time information gathering feeler spindles, formed of fingers comprised in the quarter and minute racks and/or pieces, to search for information relating to the strike sequence that the main striking mechanism has to play, on time references, formed by the snails or similar, driven by the timepiece movement 200.

Bolt 537 is only released at the end of the striking cycle of time display by the minute repeater, the pivoting of the second lever 536 causes a movement of translation of an arm-lever 523, which in turn pivots an arm-lever 522 arranged to cooperate with a recess 539 in the large control device 401. Arm-lever 522 then pushes the control rod linkage 700, particular large control device 401, to isolate the alarm, by locking said linkage on a beak 430 of large control device 401 by a beak 518 of a lever 517 during operation of the minute repeater. This lever 517 is uncoupled after the minute repeater has finished, to allow large control device 401 to be returned to its place by a return spring.

Figure 5:
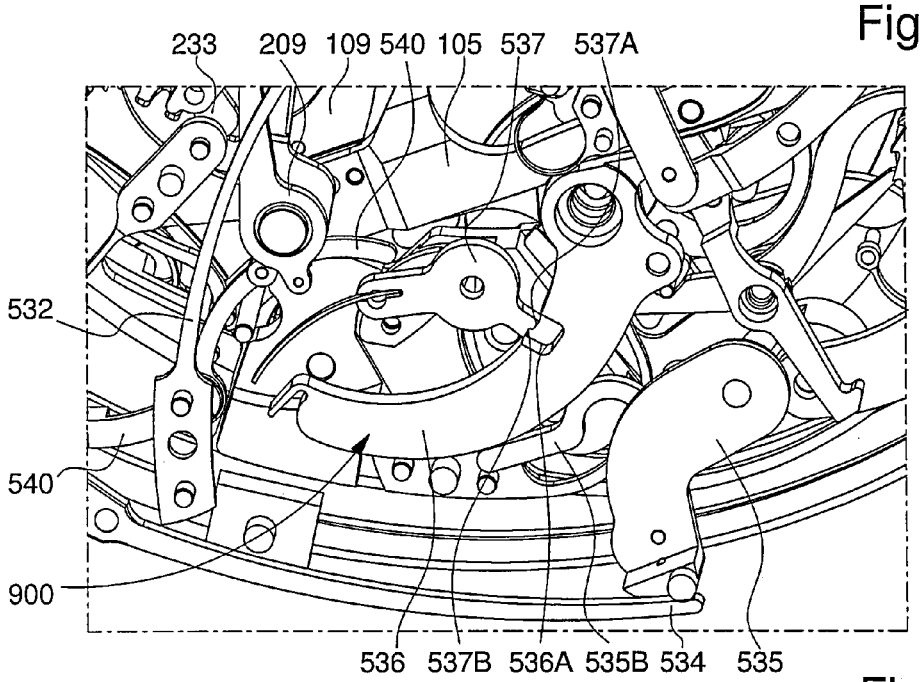

Thus, as seen in FIG. 5, the minute repeater lever 535 is arranged to cause a second minute repeater lever 536 to pivot, a catch 536A of which is arranged to cooperate with the finger 537A of a pivoting bolt 537, returned by a spring, to prevent the minute repeater from being released again once set in motion. It is only at the end of the striking cycle of time display by the minuter repeater that the bolt 537 is released, and again allows the minute repeater release button to be actuated.

Figure 21A:
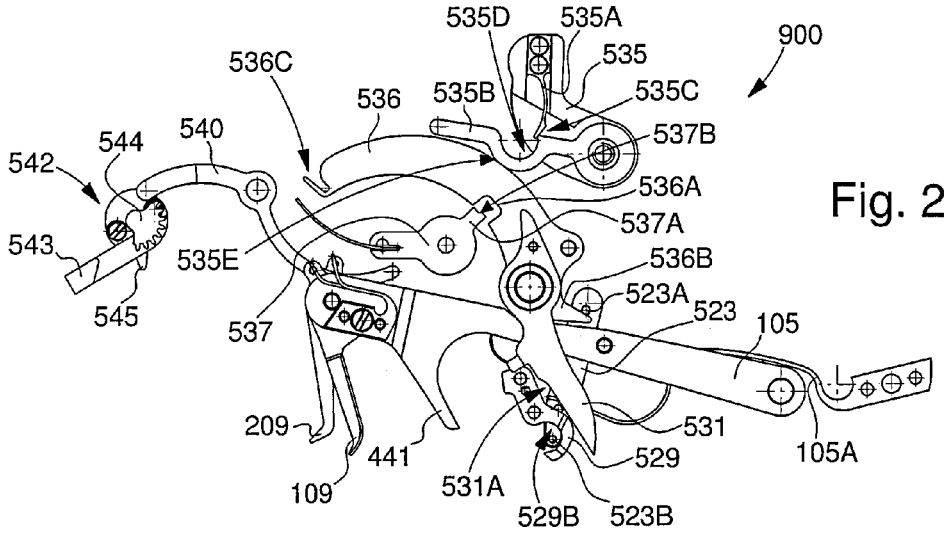
FIG. 21 is formed of three FIGS. 21A, 21B, 21C which show schematic, plan views of three successive operating steps of a safety mechanism of the invention, for protecting striking mechanisms against inadvertent actuation by the user.
Figure 21B:
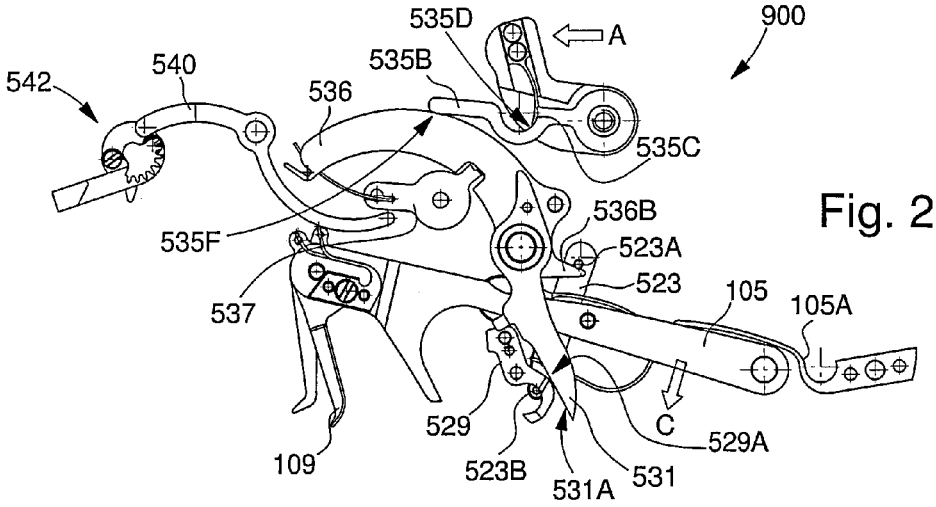

The first lever 535 includes a spring 535A, a sloping end 535C of which presses on a pivoting arm 535B also comprised in first lever 535, or at the end of a substantially circular cam 535D of said arm 535B, in a rest position seen in FIG. 21A, or inside this cam 535D in the positions in FIG. 21B, relative to the release of the strike, and 21C relative to the locking of the second lever 536 forming an intermediate push piece.

The second lever 536 includes a beak 536B, which is arranged to cooperate in abutment with a pin 523A comprised in an arm 523. The second lever 536 further includes a pivoting unhooking lever 531, a bearing face 531A of which is arranged to push a bearing face 529A of a hook 529 pivotally mounted on a plate or bridge. Arm 523 includes a second pin 523B arranged to exert pressure, in the opposite direction, on an opposite bearing face 529B of hook 529.

Figure 21C:
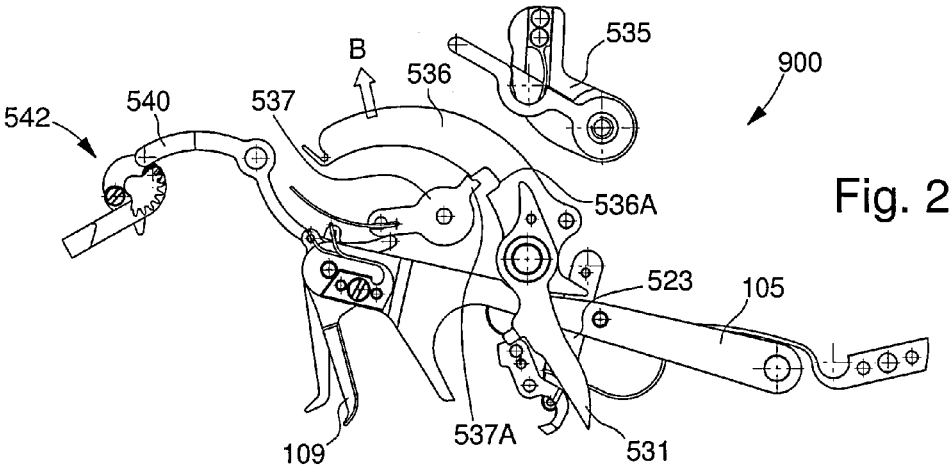

FIGS. 21A, 21B, 21C illustrate three successive operating steps of this safety mechanism 900.

In FIG. 21A, the striking mechanism is in idle mode. The slanting end 535C of spring 535A is abutting on the end of cam 535D of pivoting arm 535B. This pivoting arm 535B is abutting, via a first bearing surface 535E, on the second lever 536. The second lever 536 is in a position such that bolt 537 is released from catch 536A. Pin 523B of arm 523 is not exerting any action on hook 529.

FIG. 21B relates to the release of the strike. Activated by the user, push piece 535 pivots in the direction of arrow A and spring 535A abuts on the inside of cam 535D. Thus, arm 535B pushes the second lever 536 via a second bearing surface 535F. The second lever 536 then hooks bolt 537. The pivoting thereof moves arm 523, which is driven, on pin 523A thereof, by the beak 536B of second lever 536. Via the second pin 523B thereof, arm 523 in turn drives bearing face 529B of hook 529 This movement releases hook 429 from a pivoting hook 528 seen in FIG. 2, wound by a plate spring 532. In the hooked position, one end of this hook 528 connects plate 525 to a ratchet of an intermediate wheel which is pivoted by the strike train. The pivoting of bolt 537 allows it to abut on a lever 540 and to pivot said lever. This lever 540 then releases a gong isolating mechanism 542, connected to the movement of the minute-rack 110 and the subject of EP Patent Application No. 09175266.7, which is incorporated herein by reference. The pivoting of pivoting hook 528 allows release lever 105 to be pivoted, in the direction of arrow C, by the spring 105A thereof, said hook 109 then cooperates with ratchet 9 of the striking mechanism unit. The strike on demand then starts to play.

FIG. 21C relates to the locking of the second lever 536. When first lever 535 is pressed hard, the return torque exerted by spring 534 tends to return said first lever 535 to the rest position. The second lever 536, which is no longer retained by the first lever 535, tends to pivot in the direction of arrow B, and during this movement, hooks, via an edge of catch 536A, a step 537B comprised in finger 537A of bolt 537. It is then impossible to release the strike again until it has finished playing.

When the striking on demand mechanism has finished playing, lever 540 pivots bolt 537, which then releases the second lever 536, which can return to the rest position of FIG. 21A.

The invention further concerns a secondary strike release mechanism 1, which comprises a duration limiting mechanism 330 as described hereinbefore, and which includes a coupling mechanism 600 comprising a control rod linkage 700 which has at least a second isolator 143 for placing said timing hook 141 in or out of operation, depending on the position thereof.

The invention further concerns a repeater striking mechanism 100, including a drive arbour 120 on which there is fitted a striking mechanism unit 2, for controlling at least one lifting piece comprised in said striking mechanism 100 for activating at least one hammer, and further including a main strike control mechanism 10, which is arranged to control the pivoting of striking mechanism unit 2 and which includes a secondary strike release mechanism 1 of this type, which is integrated therein, and/or a duration limiting mechanism 330.

The invention further concerns a timepiece 1000 including at least one timepiece movement 200 and, on the one hand, at least one mechanism 400 operating a secondary strike at a specific moment linked to a pre-setting, and/or reception of a signal, and/or the breach of a threshold value for a physical parameter, and on the other hand at least one striking or grand strike or minute repeater mechanism 100 controlled by the main strike control means 10, arranged to release the striking mechanisms at times programmed by timepiece movement 200 or on demand, said timepiece 1000 including a secondary strike release mechanism 1 of this type, which is integrated therein, and/or a duration limiting mechanism 330.

The invention further concerns a secondary striking mechanism drive mechanism 350 for a striking timepiece 1000, said timepiece 1000 including at least one striking or grand strike or minute repeater mechanism 100 including a drive arbour 120 and controlled by main strike control means 10 arranged for releasing a main strike at programmed times or on demand. According to the invention, this secondary striking mechanism drive mechanism 350 includes a striking mechanism unit 2 as described hereinbefore, fitted onto drive arbour 120 for controlling at least one lifting piece for activating at least one hammer. The pivoting of detent ratchet 9 of striking mechanism unit 2 is controlled by a first click 109 of a lever 105 comprised in said secondary striking mechanism drive mechanism 350, said first click 109 being arranged to be controlled by the main strike control mechanism 10 to operate the main striking mechanism. The release wheel 118 is pivoted by a second click 209 comprised in lever 105 to control the secondary or alarm striking mechanism. This second click 209 is arranged to cooperate with a control rod linkage 700 of a secondary strike release mechanism 1 corresponding to the secondary striking mechanism. Lever 105 is arranged such that, at any given moment, only the first click 109 or respectively second click 209 is meshed with detent ratchet 9, or release wheel 118 respectively.

This secondary striking mechanism drive mechanism 350 includes a coupling wheel set 150 arranged to cooperate with a control rod linkage 700 of a secondary strike release mechanism 1 corresponding to the secondary strike. Coupling wheel set 150 pivots and carries a pinion 158 which permanently cooperates with the peripheral toothing 119 and also carries a pin 157, which cooperates with control rod linkage 700, the position of which determines the angular position of coupling wheel set 150, which is also returned to a rest position by a return spring 190. This pinion 158 meshes, in one of the coupling positions of coupling wheel set 150, with another pinion 159 mounted to pivot integrally with a star wheel 161, which controls the movement of at least one lifting piece 162 to play the secondary strike by activating a hammer 106, at a speed determined by the number of branches of star wheel 161.

Specifically in the embodiment illustrated in the Figures, this secondary striking mechanism drive mechanism 350 is an alarm striking mechanism drive mechanism, for transmitting a secondary alarm at a moment determined by the secondary strike control mechanism 400, which is an alarm control mechanism comprising a means of setting a desired alarm time.

The invention further concerns a repeater striking mechanism 100, including a drive arbour 120 pivotally mounted about a pivot axis D, and on which a striking mechanism unit 2 is fitted, to control at least one lifting piece comprised in said striking mechanism 100 for activating at least one hammer. The striking mechanism 100 includes a main strike control mechanism 10 and/or a release lever 105, and/or a first click 109 of a said lever 105, which is arranged to control the pivoting of striking mechanism unit 2.

In a specific embodiment, the repeater striking mechanism 100 is controlled by main strike control means 10, arranged to release a main strike at programmed times or on demand, and is arranged to cooperate with a secondary strike release mechanism 1 for a secondary strike, or includes a secondary strike release mechanism 1, which is integrated therein.

In a specific embodiment, the repeater striking mechanism mechanism 100 is arranged to cooperate with a secondary striking mechanism drive mechanism 350 of this type, the striking mechanism unit 2 of which cooperates with drive arbour 120 to drive at least one lifting piece for activating at least one hammer.

The invention further concerns a striking mechanism 100 including a striking mechanism unit 2 and a minute repeater that can be activated by the user by pressing on a push piece that pushes a first minute repeater control lever 535, for a timepiece 1000 comprising a timepiece movement 200, which in turn includes a motion work, which drives a release cam 530 which, in automatic operation, causes a release lever 105 to pivot towards a detent ratchet 9 comprised in striking mechanism unit 2, which is arranged, when the striking mechanism is actuated, to drive a plate 525 which carries a winding cam 440 and which includes a safety mechanism 900 as described hereinbefore.

The invention further concerns a timepiece 1000 including at least one timepiece movement 200 and, on the one hand, at least one mechanism 400 operating a secondary striking mechanism at a particular moment linked to a pre-setting, and/or reception of a signal and/or breach of a threshold value for a physical parameter, and on the other hand at least one striking or grand strike or minute repeater mechanism 100, preferably including a drive arbour 120, and controlled by main strike control means 10, arranged to release striking mechanisms at moments programmed by the timepiece movement 200 or on demand, timepiece movement 200 being arranged to control the striking mechanism 100.

Preferably, in a specific embodiment, timepiece 1000 includes a secondary strike release mechanism 1 of this type for a secondary strike at a time determined by the secondary strike control mechanism 400.

In a specific embodiment, the secondary strike release mechanism 1 includes a control rod linkage 700 arranged to allow cooperation between the first click 109 and the striking mechanism unit 2 when the secondary strike is deactivated, or to make the second click 209 cooperate with striking mechanism unit 2 when the secondary strike is activated.

In a specific embodiment, timepiece 1000 includes a secondary striking mechanism drive mechanism 350 of this type and the control rod linkage 700 is arranged to control the angular position of the coupling wheel set 150.

In a specific embodiment, this timepiece 1000 includes several secondary strike control mechanisms 400 arranged in a hierarchy and taking priority over each other in series and all taking priority over the main strike control means 10. The timepiece includes a secondary strike release mechanism 1 which includes a means of comparing the levels of priority of these secondary strike control mechanisms 400 and an isolating mechanism 800 arranged, at said particular moment of release of one of said secondary strike control mechanisms 400, to prevent the operation thereof if an acoustic signal from another secondary strike control mechanism 400 of higher priority thereto is in operation, and to allow the operation thereof if no acoustic signal from another secondary strike control mechanism 400 of higher priority thereto is in operation, in which case the isolating mechanism 800 prevents the operation of any other secondary strike control mechanism 400 of lower priority thereto.

In the specific embodiment illustrated in the Figures, the timepiece 1000 includes at least one secondary strike control mechanism 400, which is an alarm control mechanism 400, which includes a means of setting the desired alarm time, and the timepiece includes a secondary strike release mechanism 1, which is an alarm mechanism 300 and the coupling mechanism 600 is arranged, at said desired alarm time, to prevent a main strike from being actuated by uncoupling the main strike control means 10 and releasing a secondary strike by coupling all or part of the striking or grand strike or minute repeater mechanism 100.

The invention further concerns a timepiece 1000 including at least one timepiece movement 200 and including, on the one hand, at least one mechanism 400 operating a secondary striking mechanism at a particular time, and on the other hand, at least one striking or grand strike or minute repeater mechanism 100 controlled by main strike control means 10, arranged to release the striking mechanisms at times programmed by the timepiece movement 200, or on demand, and wherein each striking mechanism sequence is determined by the search for information, by time information gathering feeler spindles, on time references driven by timepiece movement 200, said timepiece 1000 further including a secondary strike release mechanism 1 including a coupling mechanism 600, arranged to allow the exclusive operation, at a given time, of either a single secondary strike control mechanism 400, or only main strike control means 10, according to the invention said coupling mechanism 600 includes a control rod linkage 700, wherein a large control device 401, activated by mode selecting means 500, carries said first isolator 142.

In a particular variant, the timepiece 1000 includes a striking or grand strike or minute repeater mechanism 100 which includes a minute repeater mechanism released by a first minute repeater lever 535, and the timepiece includes a secondary strike release mechanism 1. This mechanism 1 includes a safety mechanism 900 as described hereinbefore.

The invention further concerns a timepiece 1000 including a timepiece movement 200, which in turn includes a motion work, which drives a release cam 530, which, in automatic operation, causes a release lever 105 to pivot towards a detent ratchet 9 comprised in a striking mechanism unit 2 of a striking mechanism 100 including a minuter repeater that can be activated by the user by pressing on a push piece which pushes a first minuter repeater control lever 535, said striking mechanism unit 2 being arranged to drive a plate 525 carrying a winding cam 440, when the striking mechanism is operated. This timepiece 1000 includes a safety mechanism 900 as described hereinbefore, which is arranged to cooperate with said first minute repeater control lever 535.

In a specific embodiment, said timepiece 1000 is a wristwatch or a fob watch.

More particularly the invention concerns a timepiece 1000 including at least one movement 200, and including, on the one hand, at least one main striking mechanism 100 controlled by a main strike control mechanism 10, arranged to release strikes, either at times programmed by said movement 200, or on demand, and wherein the sequence of each strike is determined by the information gathered by feeler spindles on snails or time references driven by said movement 200, and on the other hand, a secondary strike release mechanism 2 for operating at least one secondary strike control mechanism 400 at a specific time and including a coupling mechanism 600 arranged to allow the exclusive operation, at a given time, of either a single said secondary strike control mechanism 400, or only the main strike control mechanism 10.

According to the invention, said timepiece 1 includes mode selecting means 500 for exclusively selecting, either a secondary strike mode by winding said coupling mechanism 600 to uncouple the main striking mechanism and couple a secondary striking mechanism, or a main strike mode by activating said main strike control mechanism 10 and letting down said coupling mechanism 600 to uncouple said secondary striking mechanism using said main striking mechanism 100 and, either not to play the secondary strike via said main striking mechanism 100, or to play said secondary strike by a mechanism other than said main striking mechanism 100, and further in that said coupling mechanism 600 actuates a control rod linkage 700 of an isolating mechanism 800 arranged to isolate various different release mechanisms for different strikes using, at least partially, the same main striking mechanism 100 to play said strikes, said isolating mechanism 800 includes at least a first isolator 142 which, in a first winding position, takes a stop position preventing said feeler spindles from gathering information from said snails, and, in a second let down position, allows said feeler spindles to pass to come into contact with said snails.

According to another feature of the invention, said control rod linkage 700 includes a large control stem 401, which either controls the main striking mechanism to use a part of the mechanism thereof to play the secondary strike, or which, conversely, completely uncouples the secondary striking function from the functions of the main striking mechanism, and in that said large control device 401 includes a groove 403 in which a trunnion 404 is mobile, said trunnion being comprised in said first isolator 142 which is pivotally mounted in a bridge of said timepiece 1000.

According to another feature of the invention, said large control device 401 only moves between two positions, one of which is for winding the secondary strike to allow said secondary strike to be played by the main striking mechanism, and the other is for letting down said secondary strike.

According to another feature of the invention, said isolating mechanism 800 further includes a stop member formed by a timing hook 141, which is carried by said large control rod linkage 401 and pivots thereon, said hook 141 limiting the travel of said feeler spindles.

According to another feature of the invention, this timepiece 1000 further includes at least a second isolator 143 carried by said large control rod linkage 401 to place in or out or operation, according to the position thereof, said timing hook 141, which cooperates with a timing ratchet 133 comprised in a timing wheel set 130 arranged to adjust the duration of a secondary striking mechanism signal controlled by said secondary strike control mechanism 400.

According to another feature of the invention, said first isolator 142 includes a boss 407 intended to form an obstacle in various planes parallel to said feeler spindles, which are formed by racks of the quarter-rack 111 and minute-rack 110, to prevent said feeler spindles from coming into contact with the respective quarter 102 and minute 103 snails but without preventing said main striking mechanism from operating to play a secondary strike.

According to another feature of the invention, said feeler spindles are racks or fingers of the hour and/or quarter and/or minute racks, arranged to cooperate respectively with time references driven by said timepiece movement 200 and formed by respective hour and/or quarter and/or minute snails.

According to another feature of the invention, said secondary strike control mechanism 400 is an alarm control mechanism 400 which includes a means of setting the desired alarm time.

According to another feature of the invention, said secondary strike release mechanism 1 uses all or part of said main striking mechanism 100 to play a secondary strike controlled by said secondary strike control mechanism 400, via said coupling means 600 and said control rod linkage 700 coupled to said isolating means 800, so as to allow only one command to be given at a time to a striking mechanism unit 2 integrated in said main striking mechanism 100 or interfaced therewith.

According to another feature of the invention, said mode selecting means 500 controls the pivoting, on a bridge of said timepiece 1000 of a hook 507 one end of which cooperates with a ratchet 505 integral with said mode selecting means 500, and a second end of which drives said control rod linkage 700 via a large control device 401 comprised therein, which drives, directly or indirectly via a pivoting selector lever 415, a pivoting selector part 233 which makes the selection between a first click 109 for pivoting a detent ratchet 9 to release a train of a striking mechanism unit 2 of the main striking mechanism, and a second click 209 driving a secondary strike release wheel 118.

According to another feature of the invention, said mode selecting means 500 includes a column wheel or is formed by a column wheel.

According to another feature of the invention, this timepiece 1000 includes three control members for controlling the main strike and the secondary strike, which are:

- a control finger 501 for selecting a mode in said mode selecting means 500 including a column wheel, for the exclusive selection of a single mode, either the secondary strike mode or one of the main strike modes;
- a minuter repeater release push-piece;
- a push-piece 211 for manually stopping the secondary strike prior to the end of a secondary striking cycle, said push-piece 211 being made operative when the user selects the secondary strike function and inoperative otherwise.

According to another feature of the invention, this timepiece 1000 is a wristwatch or a fob watch, and in that said large control device 401 passes substantially diametrally through said timepiece 1000 to allow direct action, with a minimum number of intermediate wheels, between functions whose mechanisms are far apart, and in that said large control device 401 is made to be rigid to ensure safety by preventing any manipulations that are dangerous for the mechanisms.

What is claimed is:

1. A timepiece, comprising:

at least one movement;

at least one main striking mechanism controlled by a main strike control mechanism, arranged to release strikes, either at times programmed by said movement, or on demand, and wherein a sequence of each strike is determined by an information gathered by feeler spindles on snails or time references driven by said movement;

a secondary strike release mechanism to operate at least one secondary strike control mechanism at a specific time and including a coupling mechanism arranged to allow an exclusive operation, at a given time, of either a single one of said secondary strike control mechanism, or only the main strike control mechanism; and a mode selecting mechanism to exclusively select, either a secondary strike mode by winding said coupling mechanism to uncouple the main striking mechanism and couple a secondary striking mechanism, or a main strike mode by activating said main strike control mechanism and letting down said coupling mechanism to uncouple said secondary striking mechanism using said main striking mechanism to play a secondary strike by a mechanism other than said main striking mechanism, and wherein said coupling mechanism actuates a control rod linkage of an isolating mechanism arranged to isolate various different release mechanisms for different strikes using the main striking mechanism to play said strikes, said isolating mechanism includes at least a first isolator which, in a first winding position, takes a stop position preventing said feeler spindles from gathering information from said snails, and, in a second let down position, allows said feeler spindles to pass to come into contact with said snails.

2. The timepiece according to claim 1, wherein said control rod linkage includes a first control stem, which either controls the main striking mechanism to use the mechanism thereof to play the secondary strike, or which, conversely, completely uncouples a secondary striking function from functions of the main striking mechanism, and wherein said first control stem includes a groove in which a trunnion is mobile, said trunnion being comprised in said first isolator which is pivotally mounted in a bridge of said timepiece.

3. The timepiece according to claim 2, wherein said first control stem only moves between two positions, one of which is for winding the secondary striking mechanism to allow said secondary strike to be played by the main striking mechanism, and the other is for letting down said secondary strike.

4. The timepiece according to claim 2, wherein said isolating mechanism further includes a stop member formed by a timing hook, which is carried by said first control stem and pivots thereon, said hook limiting the travel of said feeler spindles.

5. The timepiece according to claim 4, wherein said timepiece further includes at least a second isolator carried by said first control stem to place in or out of operation, according to the position thereof, said timing hook, which cooperates with a timing ratchet comprised in a timing wheel set arranged to adjust the duration of a secondary striking mechanism signal controlled by said secondary strike control mechanism.

6. The timepiece according to claim 2, wherein said timepiece is a wristwatch or a fob watch, and wherein said first control stem passes substantially diametraily through said timepiece.

7. The timepiece according to claim 1, wherein said first isolator includes a boss intended to form an obstacle in various planes parallel to said feeler spindles, which are formed by racks of a quarter-rack and a minute-rack, to prevent said feeler spindles from coming into contact with respective quarter and minute snails but without preventing said main striking mechanism from operating to play a secondary strike.

8. The timepiece according to claim 1, wherein said feeler spindles are racks or fingers of at least one of hour, quarter, and minute racks, arranged to cooperate respectively with time references driven by said timepiece movement and formed by at least one of respective hour, quarter, and minute snails.

9. The timepiece according to claim 1, wherein said secondary strike control mechanism is an alarm control mechanism which includes a mechanism to set the desired alarm time.

10. The timepiece according to claim 1, wherein said secondary strike release mechanism uses said main striking mechanism to play a secondary strike controlled by said secondary strike control mechanism, via said coupling mechanism and said control rod linkage coupled to said isolating mechanism, so as to allow only one command to be given at a time to a striking mechanism unit integrated in said main striking mechanism or interfaced therewith.

11. The timepiece according to claim 1, wherein said mode selecting mechanism controls the pivoting, on a bridge of said timepiece of a hook one end of which cooperates with a ratchet integral with said mode selecting mechanism, and a second end of which drives said control rod linkage via a first control stem comprised therein, which drives, directly or indirectly via a pivoting selector lever, a pivoting selector part which makes the selection between a first click to pivot a detent ratchet to release a train of a striking mechanism unit of the main striking mechanism, and a second click driving a secondary strike release wheel.

12. The timepiece according to claim 1, wherein said mode selecting mechanism includes a column wheel or is formed by a column wheel.

13. The timepiece according to claim 1, wherein said timepiece includes three control members to control the main strike and the secondary strike, which are:

- a control finger to select a mode in said mode selecting mechanism including a column wheel, for the exclusive selection of a single mode, either the secondary strike mode or one of main strike modes;
- a minute repeater release push-piece;
- a push-piece to manually stop the secondary strike prior to the end of a secondary striking cycle, said push-piece being made operative when a user selects the secondary strike function and inoperative otherwise.

* * * * *